US006227804B1

(12) United States Patent
Koga et al.

(10) Patent No.: US 6,227,804 B1
(45) Date of Patent: May 8, 2001

(54) GAS TURBINE BLADE

(75) Inventors: Akinori Koga; Hiroyuki Kawagishi; Takanari Okamura; Tsuneo Hijikata, all of Yokohama; Shokou Ito, Sagamihara, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/258,194

(22) Filed: Feb. 26, 1999

(30) Foreign Application Priority Data

Feb. 26, 1998 (JP) ..... 10-045776

(51) Int. Cl.[7] ..... F01D 5/18
(52) U.S. Cl. ..... 416/96 R; 415/115; 416/97 R
(58) Field of Search ..... 415/115; 416/96 R, 416/97 R, 96 A, 97 A, 95

(56) References Cited

U.S. PATENT DOCUMENTS

| | | | | |
|---|---|---|---|---|
| 4,604,031 | * | 8/1986 | Moss et al. | 416/96 R |
| 5,246,341 | * | 9/1993 | Hall et al. | 416/97 R |
| 5,395,212 | * | 3/1995 | Anzai et al. | 416/97 R |
| 5,472,316 | * | 12/1995 | Taslim et al. | 416/96 R |
| 5,591,007 | * | 1/1997 | Lee et al. | 416/97 R |
| 5,681,144 | * | 10/1997 | Spring et al. | 416/97 R |
| 5,873,695 | * | 2/1999 | Takeishi et al. | 416/97 R |
| 5,915,923 | * | 6/1999 | Tomita et al. | 416/96 R |
| 5,993,155 | * | 11/1999 | Endres et al. | 416/96 R |

FOREIGN PATENT DOCUMENTS 5-10101 1/1993 (JP) .

* cited by examiner

*Primary Examiner*—Christopher Verdier
*Assistant Examiner*—Richard Woo
(74) *Attorney, Agent, or Firm*—Foley & Lardner

(57) ABSTRACT

A gas turbine blade is provided with a hollow blade effective section and a blade implanted section operatively connected to the blade effective section and the gas turbine blade is formed with: a leading edge passage for guiding a cooling medium from a supply passage of the blade implanted section on a blade leading edge side of the hollow blade effective section; leading edge intermediate passages following the leading edge passage; and a trailing edge passage for guiding the cooling medium from a supply passage of a blade implanted section on a blade trailing edge side of the hollow blade effective section. The leading edge passage being provided with a heat transfer accelerating element which is arranged in a right ascendant state inclined to an advancing flow direction of the cooling medium when supplying the cooling medium from the blade implanted section to a blade tip section side or left (leading edge side) ascendant state from the blade tip section to the blade implanted section. The trailing edge passage being provided with a heat transfer accelerating element which is arranged in a left (trailing edge counter side) ascendant state inclined to the advancing flow direction of the cooling medium when supplying the cooling medium from the blade implanted section to a blade tip section side.

27 Claims, 21 Drawing Sheets

RATIO OF HEIGHT "e" OF HEAT TRANSFER ACCELERATING ELEMENT TO PITCH "P" BETWEEN HEAT TRANSFER ACCELERATING ELEMENT ON UPSTREAM SIDE AND HEAT TRANSFER ACCELERATING ELEMENT ON DOWNSTREAM SIDE

GAS TURBINE BLADE

BACKGROUND OF THE INVENTION

1. Field of the Invention

The present invention relates to a gas turbine blade, in particular, having an improved cooling passages formed inside the blade.

2. Prior Art

In the latest gas turbine plant, a technique of making a gas turbine high temperature has been remarkably developed, and a gas turbine inlet combustion gas temperature has been transferred to 1500° C. or more via a former range of 1000° C. to 1300° C.

In the case where the inlet combustion gas temperature of the gas turbine is made 1500° C. or more, an allowable thermal stress of a gas turbine blade, which is representative of a gas turbine stationary blade or a gas turbine movable (rotating) blade, has already reached the limit although a heat-resisting material has been developed. In an operation having many times of start up and shut down, or in a continuous operation over a long time, there is the possibility that accidents such as a crack and breakdown happen in the heat-resisting material. For this reason, in the case where the gas turbine inlet combustion gas temperature is made high, an air is used as a technique for keeping the gas turbine blade within an allowable temperature by cooling an interior of the gas turbine blade.

However, in the case of cooling the gas turbine blade with the use of the air, the air supply source is an air compressor connected directly to the gas turbine. For this reason, several ten percents (%) of high pressure air supplied from the air compressor to the gas turbine are used for cooling the gas turbine blade. In the relationship between heat input and heat output, the gas turbine plant, which uses much cooling air, has a plant heat efficiency lower than a gas turbine plant which uses a small amount of cooling air. Therefore, it is important to reduce the cooling air so as to improve the plant heat efficiency.

In order to improve the plant heat efficiency, recently, in the gas turbine plant, an air supplied into the gas turbine blade is circulated, and then, is again recovered, so-called, an open loop system is reconsidered.

Moreover, in the gas turbine plant, the following technique has been studied. That is, a steam is used as a cooling medium in order to make high the gas turbine inlet combustion gas temperature and to secure a high power. In that case, the steam supplied into the gas turbine blade is circulated.

As described above, in the recent gas turbine plant, even in the case where the air or steam is used as a cooling medium, the cooling medium supplied into the gas turbine blade is again recovered, and then, the recovered cooling medium is supplied for heat utilization to other equipments, whereby it is expected that the plant heat efficiency is further improved.

In the case of supplying a cooling medium into the gas turbine blade, the cooling medium is circulated to the gas turbine blade to be cooled, and thereafter, is supplied for heat utilization to other equipments. Therefore, a plant heat efficiency can be further improved unlike the conventional case where the cooling medium after cooling the blade joins together with a gas turbine driving gas (main stream). Further, the cooling medium cools the inside of the blade, and thereafter, is recovered, so that there is no disturbance of a stream line of the gas turbine driving gas. Therefore, a blade efficiency can be improved.

Even promising cooling medium recovery type gas turbine plant described above has some problems in the case of supplying the cooling medium into the blade and circulating it. One of these problems is to improve a heat transfer coefficient and to reduce a pressure loss.

Ordinarily, a leading edge or trailing edge of the gas turbine blade is requested having a thin wall thickness to improve a flow performance in spite of receiving a high thermal load of the gas turbine driving gas. Further, the leading edge or trailing edge of the gas turbine blade is required having a streamline shape having a larger curvature. For this reason, a cooling passage section area and the ratio of cooling surface area to an outer surface area inevitably become small as compared with the middle of the blade. In the case of the aforesaid cooling medium recovery type gas turbine, it is disadvantageous to plant efficiency to provide film cooing or ejection holes in a blade wall. For this reason, the following problem arises. That is, a cooling efficiency as a design value is not obtained by convection cooling of merely circulating the cooling medium. Further, a pressure loss of the cooling medium becomes great, and a velocity of flow lowers, resulting in local superheat. Therefore, effective cooling method is required for a blade leading edge and trailing edge.

Recently, in order to improve a heat transfer coefficient of the cooling medium, there has been frequently proposed a technique of providing a rod-like rib in a cooling passage of the gas turbine blade.

However, in the case of providing a rib which functions as a heat transfer accelerating element in the cooling passage of the blade, a pressure loss increases unless the heat transfer accelerating element is located on a proper position. As a result, a flow rate of cooling medium excessively increases, and for this reason, a heat transfer coefficient as a design value can not be obtained. Therefore, proper arrangement of ribs or new ribs are required in order to effectively cool the gas turbine blade.

SUMMARY OF THE INVENTION

The present invention has been made on the basis of the technical background as described above, and an object of the present invention is to provide a gas turbine blade which is constructed in a manner that a heat transfer accelerating element is located on a proper position even if a cooling area is small, and a pressure loss is reduced so as to achieve effective cooling by a cooling medium.

The above and other objects can be achieved according to the present invention by providing, in one aspect, a gas turbine blade provided with a hollow blade effective section and a blade implanted section operatively connected to the blade effective section, the gas turbine blade including:

a leading edge passage for guiding a cooling medium from a supply passage of the blade implanted section on a blade leading edge side of the hollow blade effective section;

leading edge intermediate passages following the leading edge passage; and a trailing edge passage for guiding the cooling medium from a supply passage of a blade implanted section on a blade trailing edge side of the hollow blade effective section, the leading edge passage being provided with a heat transfer accelerating element which is arranged in a right ascendant state inclined to an advancing flow direction of the cooling medium when supplying the cooling medium from the blade implanted section to a blade tip section side or left (leading edge side) ascendant state from the blade tip section to the blade implanted section, or the trailing edge passage being provided with a heat transfer accelerating element which is arranged in a left (trailing edge counter side) ascendant state inclined to the advancing flow direction of the cooling medium when supplying the cooling medium from the blade implanted section to a blade tip section side.

In another aspect, there is provided a gas turbine blade provided with a hollow blade effective section and a blade implanted section operatively connected to the blade effective section, the gas turbine blade including:

a leading edge passage for guiding a cooling medium from a supply passage of the blade implanted section on a blade leading edge side of the hollow blade effective section;

a leading edge intermediate passages for supplying a cooling medium like a serpentine via a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, the leading edge passage, the leading edge intermediate passage and the leading edge return passage being provided with a heat transfer accelerating element which is arranged in a right ascendant state or left ascendant state inclined to an advancing flow direction of the cooling medium, and the trailing edge passage and the trailing edge return passage being provided with a heat transfer accelerating element which is arranged in a left ascendant state inclined to the advancing flow direction of the cooling medium.

In the above aspect, the heat transfer accelerating element located on the leading edge passage or on the trailing edge passage is alternately arranged with respect to a blade wall on a ventral side and a back side. The heat transfer accelerating element located on the leading edge passage or on the trailing edge passage is arranged in plural lines of stages. The heat transfer accelerating element located on the leading edge passage or on the trailing edge passage is arranged in plural lines of stages, and the heat transfer accelerating element located on one line is alternately arranged with respect to a heat transfer accelerating element located on an adjacent line. The heat transfer accelerating element located on the trailing edge passage is arranged on only blade wall on the ventral side.

The leading edge bent portion on the blade implanted section side of the leading edge intermediate passage is provided with a guide plate.

In a further aspect of the present invention, there is provided a gas turbine blade provided with a hollow blade effective section and a blade implanted section operatively connected to the blade effective section, the gas turbine blade including:

a trailing edge passage for guiding a cooling medium from a blade trailing edge outer side supply passage of the blade implanted section on a blade trailing edge side of the hollow blade effective section;

a leading edge passage for recovering the cooling medium from the trailing edge passage to a blade leading edge outer side recovery passage of the blade implanted section via a blade tip section passage formed on a blade tip section side;

a blade trailing edge inner side passage which is formed on an inner side of the trailing edge passage, the blade tip section passage and the leading edge passage, and guides the cooling medium from a blade trailing edge inner side supply passage independent from the blade trailing edge outer side supply passage;

an inner side intermediate passage for guiding the cooling medium like a serpentine via a bent portion formed on the blade tip section passage side and on the blade platform side; and a leading edge inner side passage for recovering the cooling medium from the inner side intermediate passage to a blade leading edge inner side recovery passage independent from the blade leading edge outer side recovery passage, the trailing edge passage, the blade tip section passage, the leading edge passage, the blade trailing edge inner side passage, the inner side intermediate passage and the leading edge inner side passage being provided with heat transfer accelerating elements which are arranged in a left ascendant state inclined to the advancing flow direction of the cooling medium.

In this aspect, a guide plate is provided at a bent portion on the blade platform side of the inner side intermediate passage.

In a still further aspect, there is provided a gas turbine blade provided with a hollow blade effective section and a blade implanted section operatively connected to the blade effective section, the gas turbine blade including:

a leading edge passage for guiding a cooling medium from a supply passage of a blade implanted section on a blade leading edge side of a hollow blade effective section;

a leading edge intermediate passages for supplying a cooling medium like a serpentine via a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, the leading edge passage being provided with a heat transfer accelerating element which is arranged in a right ascendant state inclined to an advancing flow direction of the cooling medium, the leading edge intermediate passage on an upstream side of the cooling medium of the leading edge intermediate passages being provided with a heat transfer accelerating element which is arranged in a right ascendant state inclined to the advancing flow direction of the cooling medium, the adjacent leading edge intermediate passage on a downstream side of the cooling medium being provided with a heat transfer accelerating element which is arranged in a left ascendant state inclined to the advancing flow direction of the cooling medium, the leading edge return passage being provided with a heat transfer accelerating element which is arranged in a right ascendant state inclined to the advancing flow direction of the cooling medium, and the trailing edge passage and said trailing edge return passage being provided with a heat transfer accelerating element which is arranged in a left ascendant state inclined to the advancing flow direction of the cooling medium.

In a still further aspect, there is provided a gas turbine blade provided with a hollow blade effective section and a blade implanted section operatively connected to the blade effective section, the gas turbine blade including:

a leading edge passage for guiding a cooling medium from a supply passage of a blade implanted section on a blade leading edge side of a hollow blade effective section;

a leading edge intermediate passages for supplying a cooling medium like a serpentine via a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, the leading edge passage being provided with a heat transfer accelerating element which is arranged in a right ascendant state inclined to an advancing flow direction of the cooling medium, the leading edge intermediate passage being provided with heat transfer accelerating elements which are arranged in a left ascendant state inclined to the advancing flow direction of the cooling medium from the leading edge bent portion of the blade implanted section of the leading edge intermediate passage to the adjacent leading edge intermediate passage on a downstream side of the cooling medium, and which are located on a ventral side and a back side, the leading edge intermediate passage on an upstream side of the cooling medium of the leading edge intermediate passages being provided with a heat transfer accelerating element which is arranged in a left ascendant state inclined to the advancing flow direction of the cooling medium, the adjacent leading edge intermediate passage on a downstream side of the cooling medium being provided with a heat transfer accelerating element which is arranged in a left ascendant state inclined to the advancing flow direction of the cooling medium, and the trailing edge passage and said trailing edge return passage being provided with being provided with a heat transfer accelerating element which is arranged in a left ascendant state inclined to the advancing flow direction of the cooling medium.

In the above aspect, the heat transfer accelerating elements located on the ventral side and the back side is alternately arranged, and the heat transfer accelerating element located on the back side of the heat transfer accelerating elements located on the ventral side and the back side has an intersecting angle to the advancing flow direction of the cooling medium relatively larger than an intersecting angle to the advancing flow direction of the cooling medium of the heat transfer accelerating element located on the ventral side. The heat transfer accelerating elements are changed from the right ascendant inclined state to the left ascendant inclined state with respect to the advancing flow direction of the cooling medium from the leading edge bent portion on the blade tip section side of the leading edge intermediate passage in a manner of forming the heat transfer accelerating element so as to be changed from one having a relatively long length to one having a relatively short length. The heat transfer accelerating element is located from the leading edge bent portion on the blade tip section side of the leading edge intermediate passage, and includes a relatively short heat transfer accelerating element which is arranged in a right ascendant state inclined to the advancing flow direction of the cooling medium, and a relatively short heat transfer accelerating element which is arranged in a left ascendant state inclined to the advancing flow direction of the cooling medium.

In a still further aspect, there is provided a gas turbine blade provided with a hollow blade effective section and a blade implanted section operatively connected to the blade effective section, the gas turbine blade including:

a leading edge passage for guiding a cooling medium from a supply passage of a blade implanted section on a blade leading edge side of a hollow blade effective section;

a leading edge intermediate passages for supplying a cooling medium like a serpentine via a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, the leading edge passage being provided with a heat transfer accelerating element which is arranged in a right ascendant state inclined to an advancing flow direction of the cooling medium, the leading edge intermediate passage and the leading edge return passage being provided with a heat transfer accelerating element which is alternately arranged in a left ascendant state and a right ascendant state inclined to the advancing flow direction of the cooling medium and is located in at least two lines or more of stages, and the trailing edge passage and the trailing edge return passage being provided with being provided with a heat transfer accelerating element which is arranged in a left ascendant state inclined to the advancing flow direction of the cooling medium.

In this aspect, the leading edge intermediate passage and the leading edge return passage are provided with a heat transfer accelerating element which is alternately arranged in a left ascendant state and a right ascendant state inclined to the advancing flow direction of the cooling medium, and is located in at least two lines or more, and the heat transfer accelerating element is alternately arranged with respect to the blade wall on the ventral side and on the back side.

In the above various aspects, the heat transfer accelerating element is composed of either one of a rod-like rib having a square shape in a cross section thereof or a rod-like rib having a round shape in a cross section thereof.

In a still further aspect, there is provided a gas turbine blade, wherein a heat transfer accelerating element is constructed in a manner that an upstream side of the advancing flow direction of a cooling medium is formed as a heat transfer accelerating element leading edge, a downstream side thereof is formed as a heat transfer accelerating element trailing edge, a ventral side line connecting the heat transfer accelerating element leading edge and the heat transfer accelerating element trailing edge is formed into a straight line, and a back side line connecting the heat transfer accelerating element leading edge and the heat transfer accelerating element trailing edge is formed into a curved line which is bulged outwardly, and that the heat transfer accelerating element thus formed is located in plural lines in a cooling passage of a hollow blade effective section.

In this aspect, in the heat transfer accelerating elements located in plural lines of stages, assuming that a pitch of the heat transfer accelerating element on the upstream side on the same line and the heat transfer accelerating element on the downstream side on the same line is set as P, and a height of the heat transfer accelerating element is set as e, a ratio of the pitch P to the height e is set within a range expressed by the following equation, $$P/e=3 \text{ to } 20. \qquad \text{[Mathematical Equation 1]}$$

In a still further aspect, there is provided a gas turbine blade, wherein a heat transfer accelerating element is constructed in a manner that an upstream side of the advancing flow direction of a cooling medium is formed as a heat transfer accelerating element leading edge, a downstream side thereof is formed as a heat transfer accelerating element trailing edge, a turning portion is formed at an intermediate portion of the heat transfer accelerating element leading edge and the heat transfer accelerating element trailing edge, a ventral side surface connecting the heat transfer accelerating element leading edge and the turning portion is formed into a straight line, a back side surface connecting the heat transfer accelerating element leading edge and the turning portion is formed into a curved line which is bulged outwardly, the back side surface connecting the intermediate portion and the turning portion is formed into a linear surface, a turning ventral side surface connecting the turning portion and the heat transfer accelerating element leading edge is formed into a straight line and is bent toward the back side surface, and that a turning back side surface connecting the turning portion and the heat transfer accelerating element trailing edge is formed into a straight line, and the heat transfer accelerating element thus formed is located in plural lines of stages in a cooling passage of a hollow blade effective section.

In the above aspect, assuming that an inclination angle in a height direction from the blade wall of the cooling passage to the top portion is set as θa, the inclination angle θa of the ventral side surface is set within a range expressed by the following equation, $$30° \leqq \theta a \leqq 60°. \qquad \text{[Mathematical Equation 2]}$$

Furthermore, assuming that an inclination angle to the blade wall of the cooling passage is set as θb, the inclination angle θb of the heat transfer accelerating element trailing edge is set within a range expressed by the following equation, $$30° \leqq \theta b \leqq 60°. \qquad \text{[Mathematical Equation 3]}$$

Furthermore, assuming that inclination angles of the turning ventral side surface and the turning back side surface of the turning portion are respectively set as θc, and θd to the blade wall of the cooling passage, the inclination angles θc and θd are set within a range expressed by the following equation, $$30° \leqq \theta c,\ \theta d \leqq 60°. \qquad \text{[Mathematical Equation 4]}$$

Furthermore, assuming that the ventral side surface is formed into a straight line so as to connecting the heat transfer accelerating element leading edge and the turning portion, and an angle intersecting the advancing flow direction of the cooling medium to the blade wall of the cooling passage is set as θe, the inclination angle θe of the vertral side surface is set within a range expressed by the following equation, $$30° \leqq \theta e \leqq 60°. \qquad \text{[Mathematical Equation 5]}$$

Furthermore, either air or steam is selected as the cooling medium, and a turbine extraction of a steam turbine is selected as a steam used for the cooling medium.

According to the present invention of the structures and characters mentioned above, the following functions and effects are achieved.

The gas turbine blade according to the present invention is constructed in a manner that the heat transfer accelerating elements located in each cooling passage of the blade effective section are arranged in a so-called right ascendant state inclined to the advancing flow direction of the cooling steam, and alternately located on the ventral side and the back side of the blade, and thus, a circulating swirl based on the secondary flow is induced. Therefore, it is possible to further improve a heat transfer coefficient of the cooling medium.

In the case of guiding the cooling medium from one cooling passage to adjacent cooling passage via the bent portion, the heat transfer accelerating element, which is arranged in a right ascendant inclined state in one cooling passage, is arranged in a left ascendant inclined state in the adjacent cooling passage. Whereby the circulating swirl direction based on the secondary flow induced in one cooling passage, the circulating swirl direction based on the secondary flow induced in the adjacent cooling passage and the circulating swirl direction based on the secondary flow by a Coriolis force coincide with each other. Therefore, it is possible to keep a high heat transfer coefficient of the cooling medium and to restrict a pressure loss.

Further, in the gas turbine blade of the present invention, the heat transfer accelerating element located in the blade effective section has a ventral side line formed into a straight line, and a back side line which is formed into a curved line (like a convex) bulged outwardly. The ventral side line formed into a straight line is set to an angle intersecting with the advancing flow direction of the cooling medium, or a turning portion is formed on an intermediate portion connecting the heat transfer accelerating element leading edge and the heat transfer accelerating element trailing edge. A back side surface connecting the heat transfer accelerating element leading edge and the turning portion is formed into a curved surface which is bulged outwardly and has a straight line surface extending from the intermediate portion. Moreover, the turning ventral side surface and the turning back side surface extending from the turning portion to the heat transfer accelerating element trailing edge is set to a predetermined angle inclined to the blade wall. Therefore, it is possible to further improve a heat transfer coefficient of the cooling medium and to restrict a pressure loss.

The nature and further characteristic features of the present invention will be made more clear from the following descriptions made with reference to the accompanying drawings.

DESCRIPTION OF THE PREFERRED EMBODIMENTS

Figure 1:
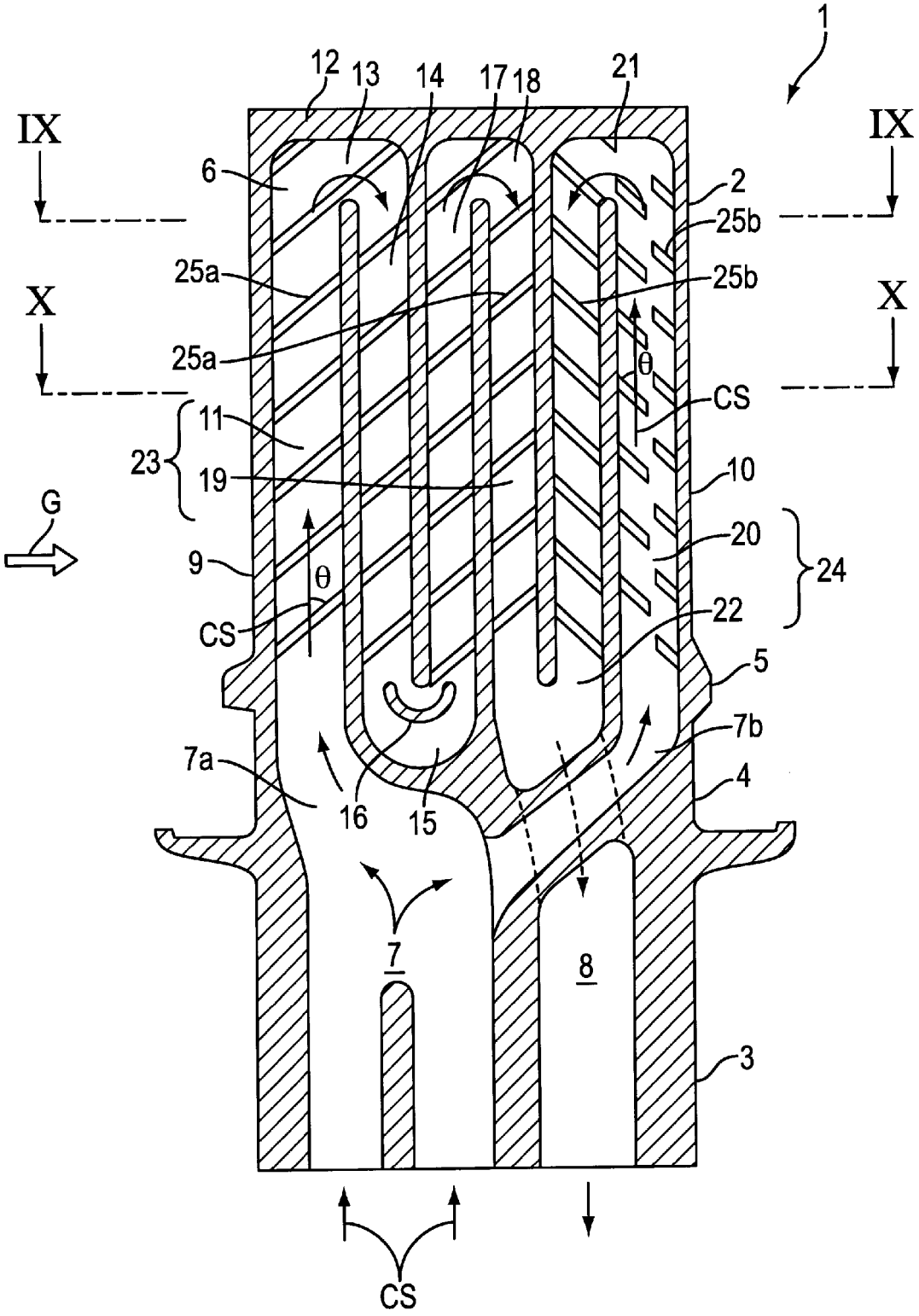
FIG. 1 is a longitudinally sectional view schematically showing a first embodiment of a gas turbine blade according to the present invention.

Embodiments of the present invention will be described below with reference to the accompanying drawings and reference numerals shown in the drawings.

FIG. 1 is a longitudinally cross sectional view schematically showing a first embodiment of a gas turbine blade according to the present invention.

A reference numeral 1 denotes the whole of a gas turbine blade. The gas turbine blade 1 is composed of a blade effective section 2 which passes a gas turbine driving gas (main stream (flow)) G so as to perform a work of expansion, a blade implanted section 3 which is implanted in a turbine shaft (not shown), a blade shank section 4 which continuously connects the blade effective section 2 and the blade implanted section 3 integrally with each other, and a blade platform 5 which is attached to the blade effective section 2.

The blade effective section 2 has a hollow shape so as to form a passage for a cooling steam CS, for example, air or steam, and is formed with a blade cooling passage 6 at the interior thereof. Moreover, the blade implanted section 3 is formed with two passages 7 and 8 which extend to a radius direction (blade height direction) of the gas turbine blade 1. One of these passages 7 and 8 is a supply passage 7 for a cooling steam CS and is independently located at a blade leading edge 9 side of the gas turbine blade 1. The other one of these passages is a recovery passage 8 for the cooling steam, and is independently located at a blade trailing edge 10 side of the gas turbine blade 1.

The supply passage 7 for the cooling steam CS extends from the bottom portion of the blade implanted section 3 to a radius direction (blade height direction) of the gas turbine blade 1. Further, the supply passage 7 forks two ways, that is, a leading edge side supply passage 7*a* and a trailing edge side supply passage 7*b* at the blade shank section 4 so that the cooling steam CS is supplied to the blade leading edge 9 and the blade trailing edge 10 of the blade implanted section 2. The trailing edge side supply passage 7*b* makes an overpass or underpass with the recovery passage 8 for the cooling steam at the blade shank section 4 so that the supply passage 7 and the recovery passage 8 are independent from each other.

The leading edge side supply passage 7*a* communicates with a leading edge passage 11 of the blade cooling passage 6 which extends to a radius direction (blade height direction) of the blade leading edge 9 of the blade effective section 2. The leading edge passage 11 is turned by an angle of 180° in its direction at a leading edge first bent portion 13 of a blade tip section 12 which is a blade distal end of the blade effective section 2 and communicates with a leading edge first intermediate passage 14.

The leading edge first intermediate passage 14 extends straight to a leading edge second bent portion 15 toward an inner diameter direction (blade platform side), and is turned by an angle of 180° in its direction via a guide plate 16, and thus, communicates with a leading edge second intermediate passage 17. Further, the leading edge second intermediate passage 17 is turned by an angle of 180° in its direction at a leading edge third bent portion 18 of the blade tip section 12 so as to form a serpentine shape, and then, communicates with a leading edge return passage 19.

The leading edge return passage 19 extends toward an inner diameter direction of the blade effective section 2 in the vicinity of the blade middle portion between the blade leading edge 9 and the blade trailing edge 10, and communicates with the recovery passage 8 at a blade root section which is the blade platform 5.

On the other hand, the trailing edge side supply passage 7*b* also communicates with a trailing edge passage 20 of the blade cooling passage 6 which extends to a radius direction (blade height direction) of the blade trailing edge 10 of the blade effective section 2. The trailing edge passage 20 is turned by an angle of 180° in its direction at a trailing edge first bent portion 21 of the blade tip section 12 of the blade effective section 2, and extends in a serpentine manner toward an inner diameter direction (blade platform side) of a trailing edge return passage 22, and thus, communicates with the recovery passage 8 at a blade root section of the blade platform 5.

Figure 2:
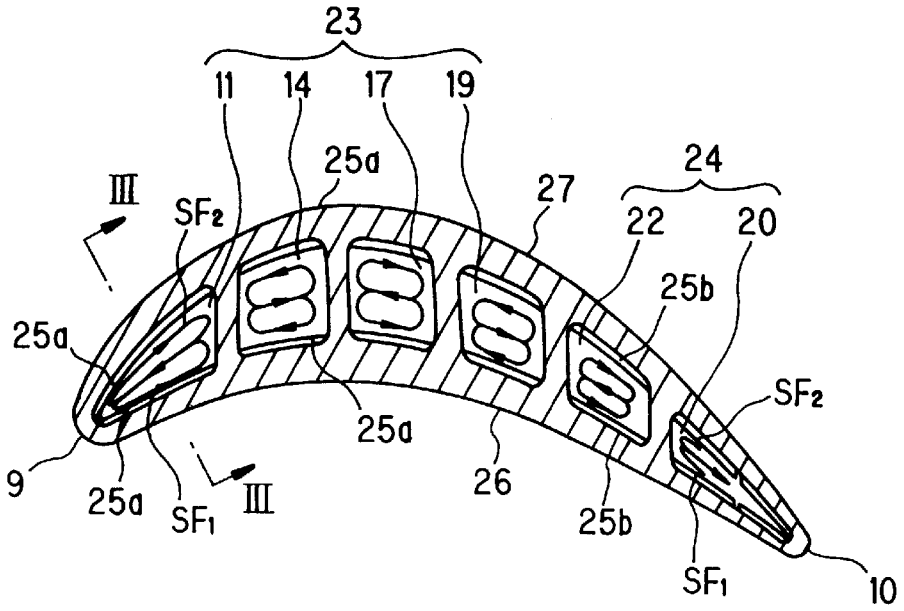
FIG. 2 is a cross sectional view cut along an arrow II—II direction of FIG. 1 to explain a direction of a circulating swirl based on a secondary flow induced by a heat transfer accelerating element.

A blade leading edge side cooling passage 23 and a blade trailing edge side cooling passage 24 are independently formed between the blade leading edge 9 side and the blade trailing edge 10 side of the blade effective section 2. As shown in FIG. 1 and FIG. 2, heat transfer accelerating elements 25*a* and 25*b* are located from the blade root section of the blade platform 5 toward the blade tip section 12 and along each blade wall on a ventral side 26 and a back side 27. Further, these elements 25*a* and 25*b* are arranged an angle of θ which is inclined to an advancing flow direction of the cooling steam CS, and, in a so-called right ascendant state or left ascendant state. More specifically, rod-like ribs having a square or round shape in cross section extend from a partition wall defining respective passages 11, 14, 17, 19, 20, and 22 to adjacent partition wall.

Figure 3:
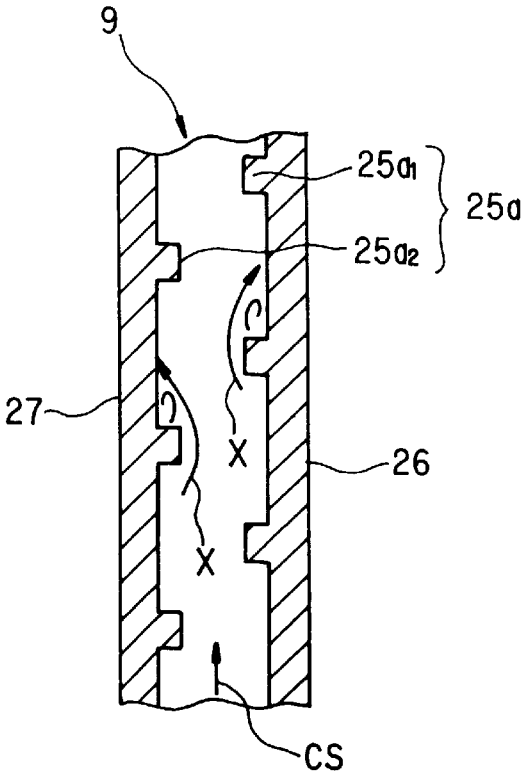
FIG. 3 is a cross sectional view cut along an arrow III—III direction of FIG. 2.

Among heat transfer accelerating elements 25*a* and 25*b*, the heat transfer accelerating element 25*a* is located in the blade leading edge side cooling passage 23 and is inclined in a right ascendant state to the advancing flow direction of the cooling steam CS. As shown in FIG. 3, a heat transfer accelerating element $\mathbf{25}a_1$ on the ventral side 26 and a heat transfer accelerating element $\mathbf{25}a_2$ on the back side 27 are alternately located from an inner diameter direction (blade platform side) to a radius direction (blade height direction. Thus, when the cooling steam CS jumps over the heat transfer accelerating element $\mathbf{25}a_1$ on the ventral side 26 and the heat transfer accelerating element $\mathbf{25}a_2$ on the back side 27, the cooling steam CS flowing through each space of adjacent back side 27 and ventral side 26 swirls up.

Figure 4:
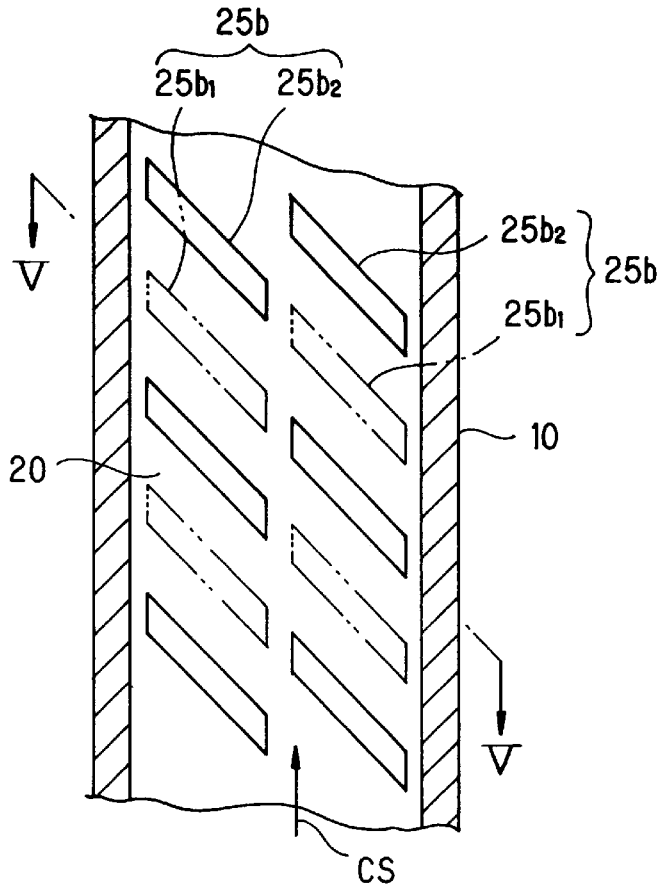
FIG. 4 is a partially enlarged longitudinal sectional view showing a blade trailing edge of the gas turbine blade shown in FIG. 1.
Figure 5:
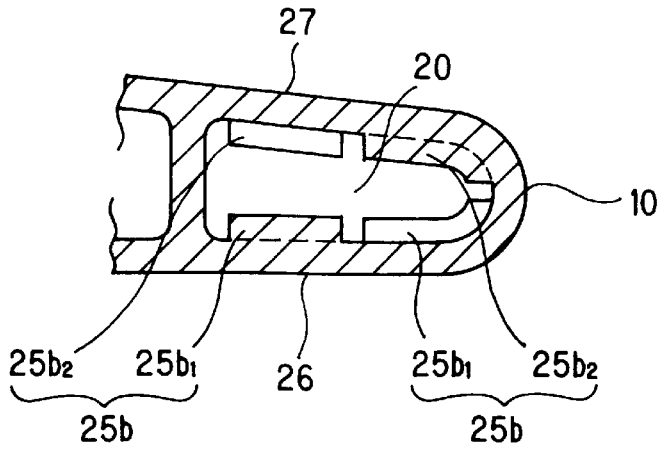
FIG. 5 is cross sectional view cut along an arrow V—V direction of FIG. 4.

Further, in the blade trailing edge side cooling passage 24, the heat transfer accelerating element 25*b* is located on the blade trailing edge 10 side and is inclined in a so-called left ascendant state to the advancing flow direction of the cooling steam CS. As shown in FIG. 4 and FIG. 5, the heat transfer accelerating element 25*b* is shortened in its length, and is arranged in two lines of stages. Then, a heat transfer accelerating element $\mathbf{25}b_1$ (shown by a chain double-dashed line) on the ventral side 26 and a heat transfer accelerating element $\mathbf{25}b_2$ (shown by a solid line) on the back side 27 are alternately located toward a radial direction (blade height direction). Likewise, when the cooling steam CS jumps over the heat transfer accelerating element $\mathbf{25}b_2$ on the ventral side 26 and the heat transfer accelerating element $\mathbf{25}b_2$ on the back side 27, the cooling steam CS flowing through each space of adjacent back side 27 and ventral side 26 swirls up.

The heat transfer accelerating element 25*b* is also located in the trailing edge return passage 22 of the blade trailing edge side cooling passage 24 and is inclined in a left ascendant state to the advancing flow direction of the cooling steam CS. Likewise the aforesaid heat transfer accelerating element 25*a* located on the blade leading side cooling passage 23, a heat transfer accelerating element 25*b*, on the ventral side 26 and a heat transfer accelerating element $\mathbf{25}b_2$ on the back side 27 are alternately located from the blade tip section 12 toward the blade root section of the blade platform 5.

Figure 6:
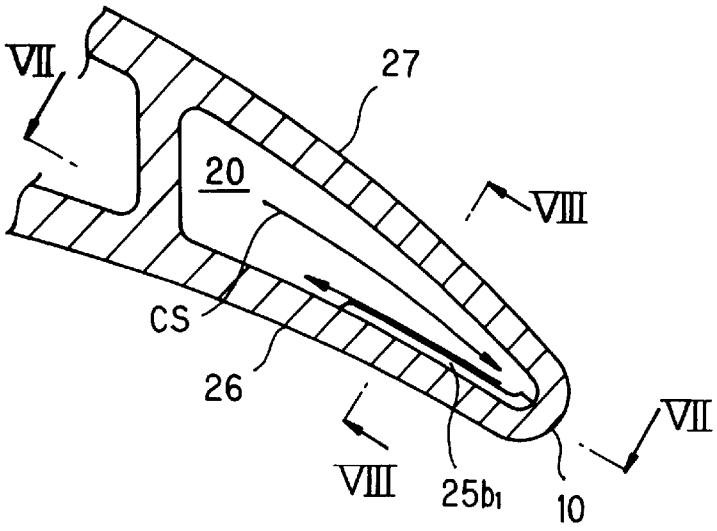
FIG. 6 is a partially enlarged transverse sectional view showing another embodiment of the blade trailing edge of the gas turbine blade according to the present invention.
Figure 7:
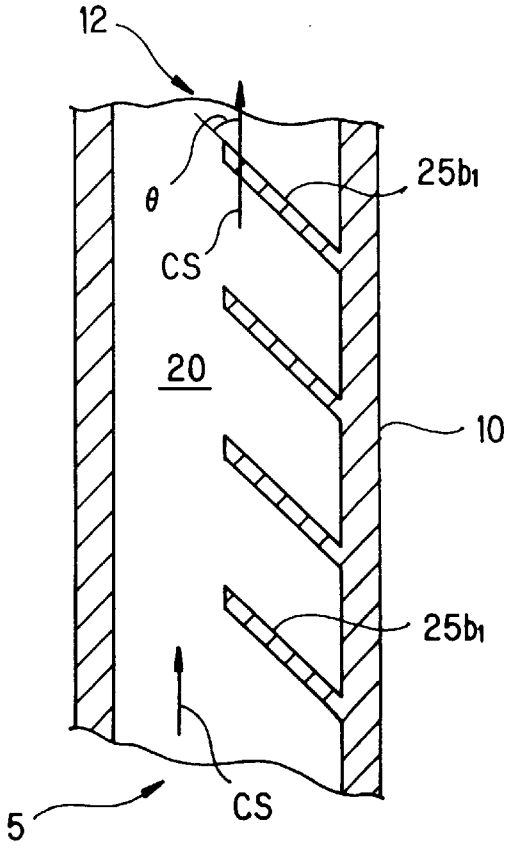
FIG. 7 is a longitudinal sectional view cut along an arrow VII—VII direction of FIG. 6.
Figure 8:
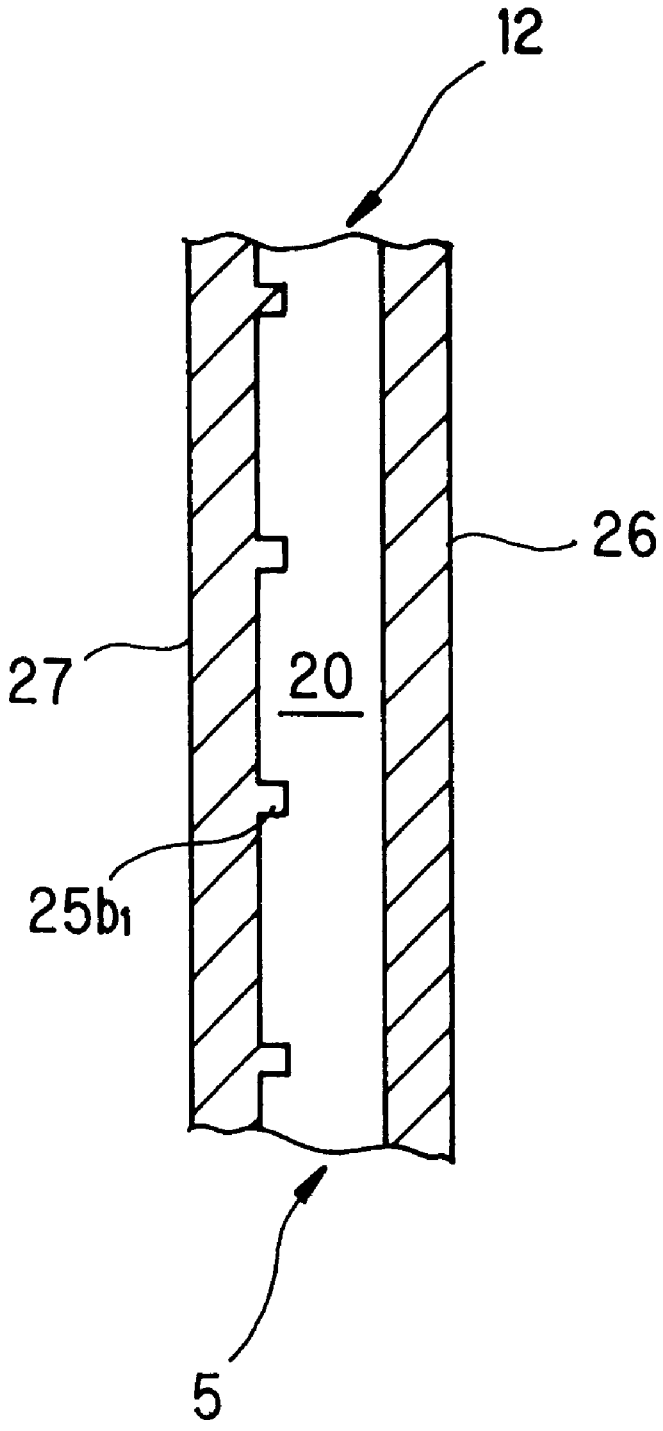
FIG. 8 is a longitudinal sectional view cut along an arrow VIII—VIII direction of FIG. 6.

As shown in FIG. 6, the heat transfer accelerating element 25*b* located on the blade trailing edge 10 side may be provided with a heat transfer accelerating element $\mathbf{25}b_1$ at only one side of the ventral side 26. In the case of locating the heat transfer accelerating element $\mathbf{25}b_1$ at only one side of the ventral side 26, as shown in FIG. 7 and FIG. 8, the heat transfer accelerating element $\mathbf{25}b_1$ extends along a blade wall of the ventral side 26 from the blade root section of the blade platform 5 toward the blade tip section 12, and is arranged at an angle of θ which is inclined to an advancing flow direction of the cooling steam CS, in a so-called left ascendant state. In the case of supplying much cooling steam CS to the blade trailing edge 10 side, the heat transfer accelerating element 25*b*1 is located at only one side on a ventral side 18. By doing so, in particular, it is possible to improve a strength on the ventral side 18 receiving a high thermal load by a gas turbine driving gas, and further, a pressure loss of the cooling steam CS can be reduced.

Next, the following is a description on an operation of the gas turbine blade according to the present invention.

The gas turbine blade 1 of this embodiment is effectively cooled with a higher heat transfer coefficient and at a lower pressure loss of the cooling steam CS during a gas turbine operation.

In the gas turbine operation, the cooling steam CS supplied to the supply passage 7 of the blade implanted section 3 is divided into the leading edge side supply passage 7*a* and the trailing edge side supply passage 7*b* at the blade shank section 4, and then, the cooling steam CS thus divided are guided into the blade leading edge side supply passage 23 and the blade trailing edge side cooling passage of the blade cooling passage 6, respectively.

Figure 10:
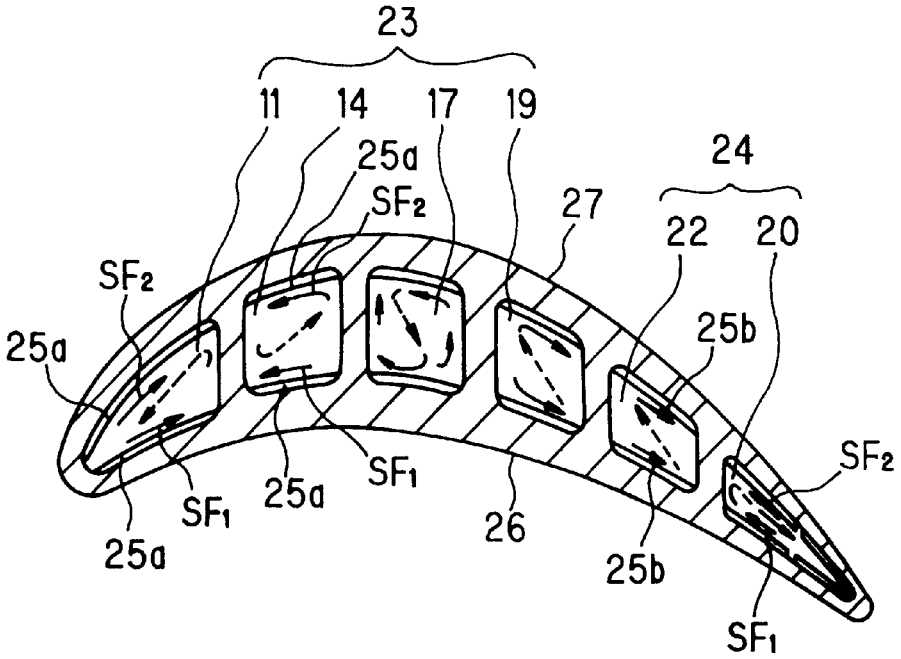
FIG. 10 is a cross sectional view cut along an arrow X—X direction of FIG. 1 to explain a direction of a circulating swirl based on a secondary flow induced by a Coriolis force.

The cooling steam CS guided to the blade leading edge cooling passage 23 is first guided to the leading edge passage 11 of the blade effective section 2. Then, the cooling steam CS guided to the leading edge passage 11 has a velocity component crossing in the advancing flow direction. Therefore, the cooling stream CS flows along the heat transfer accelerating element 25*a* which is inclined in a so-called right ascendant state. In this case, as shown in FIG. 2, a so-called secondary flows $SF_1$ and $SF_2$ are induced with respect to the ventral side 26 and the back side, respectively. These secondary flows $SF_1$ and $SF_2$ are a circulating swirl flowing to a direction shown by an arrow. At this time, in the cooling steam CS, a Coriolis force is generated as shown in FIG. 10, and further, the cooling steam CS flows to the same direction as the circulating swirl based on the Coriolis force. For this reason, the secondary flows $SF_1$ and $SF_2$ are accelerated in its direction so as to improve a heat transfer coefficient.

As described above, in the cooling steam CS, these secondary flow $SF_1$ and $SF_2$ are accelerated in its direction by the Coriolis force, and thereby, a heat transfer coefficient can be improved. Thus, when the cooling steam CS jumps over the heat transfer accelerating elements 25*a,* and 25$a_2$ on the ventral side 26 and on the back side 27, the cooling steam CS flowing through each space of adjacent back side 27 and ventral side 26 swirls up, and then, is continuously exchanged into a new cooling steam CS, so that a heat transfer coefficient can be increased. Therefore, a wall surface of the leading edge passage 11 can be effectively cooled.

Figure 9:
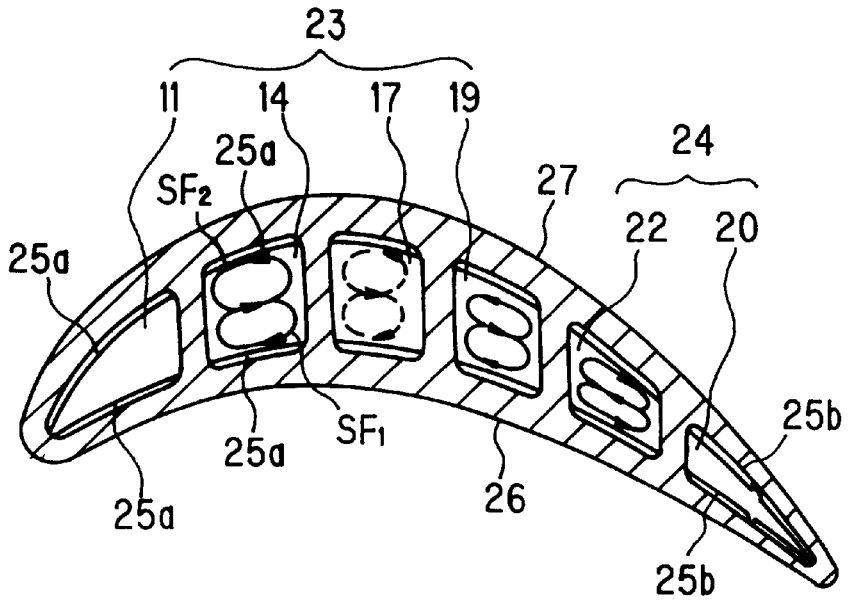
FIG. 9 is a cross sectional view cut along an arrow IX—IX direction of FIG. 1 to explain a direction of a circulating swirl based on a secondary flow induced by each bent portion of a cooling passage.

The cooling steam CS passed through the leading edge passage 11 is turned by an angle of 180° at the leading edge first bent portion 13 of the blade tip section 12, and then, flows to the leading edge first intermediate passage 14. In this case, the secondary flow $SF_1$ and $SF_2$ of the cooling steam CS has a circulating swirl direction shown by an arrow as shown in FIG. 9 when passing through the leading edge first bent portion 13. As seen from FIG. 2, the circulating swirl direction coincides with the circulating swirl direction of the cooling steam CS flowing through the leading edge first intermediate passage 14, and also, coincides with the circulating swirl direction by Coriolis force as shown in FIG. 10.

Therefore, the cooling steam CS serves to improve a heat transfer coefficient because the secondary flows $SF_1$ and $SF_2$ have the circulating swirl direction coincident with each other.

The cooling steam CS passed through the leading edge first intermediate passage 14 is turned by an angle of 180° at the leading edge second bent portion 15, and then, when flowing into the leading edge intermediate passage 17, the cooling steam CS is guide by means of the guide plate 16.

In general, the circulating swirl direction by the secondary flow $SF_1$ and $SF_2$ of the cooling steam CS becomes reverse when the cooling steam CS is turned by an angle of 180° at the leading edge second bent portion 15. Further, the circulating swirl direction by the Coriolis force also becomes reverse. Then, the aforesaid turned direction circulating swirl is applied to the cooling steam CS, and the initial cooling steam CS is offset in its circulating swirl direction. As a result, it is impossible to maintain a high heat transfer coefficient, and because of this reason, in this embodiment, the leading edge second bent portion 15 is provided with the guide plate 16, and a cross sectional area of the leading edge second bent portion 15 is made relatively large to reduce a velocity of flow. As a result, the circulating swirl direction shown in FIG. 2 and the circulating swirl direction shown by the broken line of FIG. 9 coincide with each other so that a heat transfer of the cooling steam CS can be prevented from being lowered. In this case, the circulating swirl direction shown by the broken line of FIG. 9 is observed from the blade root section which is the blade platform 5.

The cooling steam CS straight advances from the leading edge second intermediate passage 17 toward a radial direction (blade height direction), and then, is turned by an angle of 180° at the leading edge third bent portion 18. At this time, the circulating swirl direction by the secondary flow $SF_1$ and $SF_2$ shown in FIG. 9 and the direction shown in FIG. 2 and FIG. 10 coincide with each other so as to keep a high heat transfer efficient, and then, the cooling steam CS effectively cools the leading edge return passage 19, and thereafter, is guided to the recovery passage 8.

On the other hand, in the blade trailing edge side cooling passage 24, the cooling steam CS guided to the trailing edge passage 20 also flows along the heat transfer accelerating elements 25*b* which are arranged in two lines in a so-called left ascendant state inclined to the advancing flow direction of the cooling steam CS, and then, induces the secondary flows $SF_1$ and $SF_2$ in the ventral side 26 and the back side 27 as shown in FIG. 2. These secondary flows $SF_1$ and $SF_2$ are a circulating swirl flowing to a direction shown by an arrow. At this time, in the cooling steam CS, a Coriolis force is generated as shown in FIG. 10; therefore, the circulating swirl direction of these secondary flow $SF_1$ and $SF_2$ is the same as the circulating swirl direction based on the Coriolis force. Thus, these secondary flows $SF_1$ and $SF_2$ are accelerated in its direction so as to keep a high heat transfer coefficient.

As described above, in the cooling steam CS, the secondary flows $SF_1$ and $SF_2$ are accelerated in its direction by the Coriolis force so as to keep a high heat transfer coefficient. For this reason, when the cooling steam CS jumps over the heat transfer accelerating elements 25$b_1$ and 25$b_2$ on the ventral side 26 and the back side 27 shown in FIG. 4 and FIG. 5, the cooling steam CS in each space of the ventral side 26 and on the back side 27 swirls up, and then, is continuously exchanged into a new cooling steam CS so as to improve a heat transfer coefficient. Therefore, even if the trailing edge passage has a relatively narrow passage area, it is possible to effectively cool a wall surface of the trailing edge passage 20.

The cooling steam CS passed through the blade trailing edge 20 is turned by an angle of 180° at the trailing edge bent portion 21 of the blade tip section 12, and then, flows to the trailing edge return passage 22. At this time, the circulating swirl direction by the secondary flow $SF_1$ and $SF_2$ shown in FIG. 9 and the direction shown in FIG. 2 and FIG. 10 coincide with each other so as to keep a high heat transfer efficient, and the cooling steam CS preferably cools the trailing edge return passage 22, and thereafter, joins together with the cooling steam Cs from the leading edge return passage 19 at the recovery passage 8.

As described above, in this embodiment, when cooling the blade leading edge side cooling passage 23 and the blade trailing edge side cooling passage 24 of the gas turbine blade 1 with the use of the cooling steam CS, in the cooling steam CS, the secondary flows $SF_1$ and $SF_2$ are induced by the heat transfer accelerating elements 25*a* and 25*b* which are arranged in a right ascendant state or left ascendant state inclined to the advancing flow direction of the cooling steam CS. Thus, the circulating swirl based on these secondary flows $SF_1$ and $SF_2$ serves to enhance a heat transfer coefficient, particularly making very high at the secondary flow impinging side, i.e. leading edge 9 and trailing edge 10 side. This is caused by strong vortex induced by the leading end portion of elements 25*a* and 25*b* and approaching fluid of lower temperature and higher speed than the circumferential fluid near the wall. Therefore, portions 9 and 10 are effectively cooled. Further, the heat transfer accelerating elements 25*a* and 25*b* located on the ventral side 26 and the back side 27 are alternately located along a radial direction (blade height: direction), and when the cooling steam CS jumps over the heat transfer accelerating elements 25*a* and 25*b* located on the ventral side 26 and the back side 27, the cooling steam CS in each space on the ventral side 26 and the back side swirls up, and thereby, the cooling steam CS is exchanged into a new cooling steam CS so as to further enhance a heat transfer coefficient. Therefore, it is possible to further effectively cool each wall surface of the leading edge passage 11 and the trailing edge passage 20.

Moreover, in this embodiment, the circulating swirl based on these secondary flows $SF_1$ and $SF_2$ induced in cooling passages 23 and 24 is further accelerated in its directivity by the Coriolis force, and the circulating swirl directions in bent portions 13, 18 and 21 coincide with each other. Therefore, it is possible to further restrict a pressure loss of the cooling steam CS. Further, when the cooling steam CS is turned by an angle of 180° at the leading edge second bent portion 15, the circulating swirl direction based on the secondary flows $SF_1$ and $SF_2$ of the leading edge first intermediate passage 14 and the circulating swirl direction based on the secondary flows $SF_1$ and $SF_2$ based on the Coriolis force become reverse in its direction, and then, the heat transfer coefficient of the cooling steam CS is reduced. However, a cross sectional area of the leading edge second bent portion 15 is made relatively large so as to reduce a velocity of flow, and the guide plate 16 is provided therein so as to make smooth the flow of cooling steam CS. Therefore, it is possible to restrict a reduction in the heat transfer coefficient of the cooling steam CS.

Figure 11:
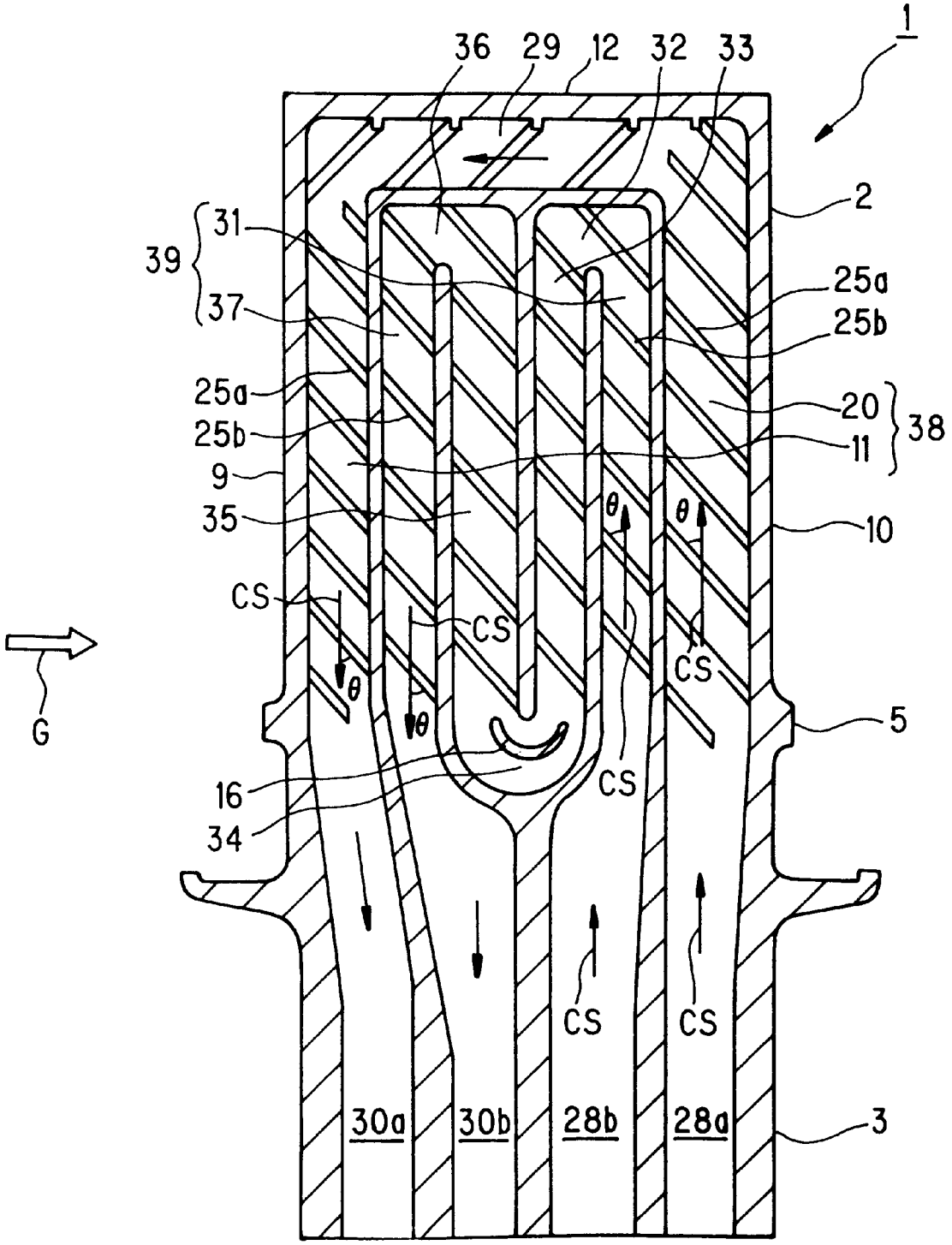
FIG. 11 is a longitudinally sectional view schematically showing a second embodiment of a gas turbine blade according to the present invention.

FIG. 11 is a longitudinally sectional view schematically showing a second embodiment of a gas turbine blade according to the present invention. Incidentally, like reference numerals are used to designate the same components as the first embodiment or parts corresponding thereto.

A gas turbine blade 1 of this second embodiment is provided with passages 28*a* and 28*b* which divide the blade effective section 2 into two parts so as to cool the gas turbine blade 1. One of these passages 28*a* and 28*b* is a blade trailing edge outer side supply passage 28*a* of the cooling steam CS which is independently formed on the blade trailing edge 10 side of the gas turbine blade 1, and the other one of these passages is a blade trailing edge inner side supply passage 28*b* of the cooling steam CS which is independently formed inside the aforesaid blade trailing edge outer side supply passage 28*a*.

The blade trailing edge outer side supply passage 28*a* of the cooling steam CS communicates with a trailing edge passage 20 which extends from the blade implanted section 3 to a radial direction (blade height direction) of the blade trailing edge 10 of the blade effective section 2. The trailing edge passage 20 is bent in its cross section at the blade tip section 12 which is a distal end of the blade effective section 2 so that a blade tip section passage 29 is formed. The blade tip section passage 29 extends to the blade leading edge 9 side. Further, the blade tip section passage 29 is again bent at its end portion, and then, communicates with a blade leading edge outer side recovery passage 30*a* via the leading edge passage 11 extending to an inner diameter direction (the blade root section of the blade platform 5) of the blade leading edge 9.

Likewise, the blade trailing edge outer side supply passage 28*b* also communicates with a blade trailing edge side inner passage 31 which extends from the blade implanted section 3 to a radial direction (blade height direction) of the blade trailing edge 10 of the blade effective section 2 and is arranged in parallel with the trailing edge passage 20. The blade trailing edge side inner passage 31 is turned by 180° at a first bent portion 32 of the blade tip section passage 29 and communicates with an inner first intermediate passage 33 which extends toward an inner diameter direction of the blade leading edge 9. Further, the blade trailing edge side inner passage 31 is again turned by 180° via a guide plate 16 located on a second bent portion 34 of the inner first intermediate passage 33, and then, extends like a serpentine to an inner second intermediate passage 35. Furthermore, the blade trailing edge side inner passage 31 is turned by 180° at a third bent portion 36 of the inner second intermediate passage 35 blade tip section passage 29 and communicates with a blade leading edge side inner recovery passage 30*b* via a leading edge side inner passage 37 which extends to an inner diameter direction of the blade leading edge 9.

The blade effective section 2 is divided into two parts, that is, an outer cooling passage 38 and an inner cooling passage 39 which are independently formed. These outer and inner cooling passages 38 and 39 are provided with heat transfer accelerating elements 25*a* and 25*b*. Further, these elements 25*a* and 25*b* are arranged at an angle of θ which is inclined in a so-called left ascendant state to an advancing flow direction of the cooling steam CS flowing from the blade root section of the blade platform 5 toward the blade tip section 12 and the blade tip section passage 29. More specifically, rod-like ribs having a square or round shape in its cross section extend from a partition wall defining respective passages 20, 29, 11, 31, 33, 35 and 37 to adjacent partition wall. Also, these heat transfer accelerating elements 25*a* and 25*b* are alternately located on the ventral side and the back side like the first embodiment.

As described above, in this second embodiment, the blade effective section 2 is divided into two parts, that is, an outer cooling passage 38 and an inner cooling passage 39 which are independently formed, and much cooling steam is supplied by the blade trailing edge 10 and the blade leading edge 9. Further, the respective passages 38 and 39 are provided with heat transfer accelerating elements 25*a* and 25*b* which are inclined in a left ascendant state so as to further improve a heat transfer coefficient of the cooling steam CS. Therefore, it is possible to effectively cool the blade leading edge 9 and the blade trailing edge 10 which have not sufficiently been cooled before because a passage area is relatively small.

Moreover, in this second embodiment, the outer cooling passage 38 and the inner cooling passage 39 formed in the blade effective section 2 are each simplified in its structure, so that the cooling steam CS can be relatively smooth supplied. In particular, the outer cooling passage 38 is formed into one straight path, so that a pressure loss of the cooling steam CS can be restricted.

Figure 12:
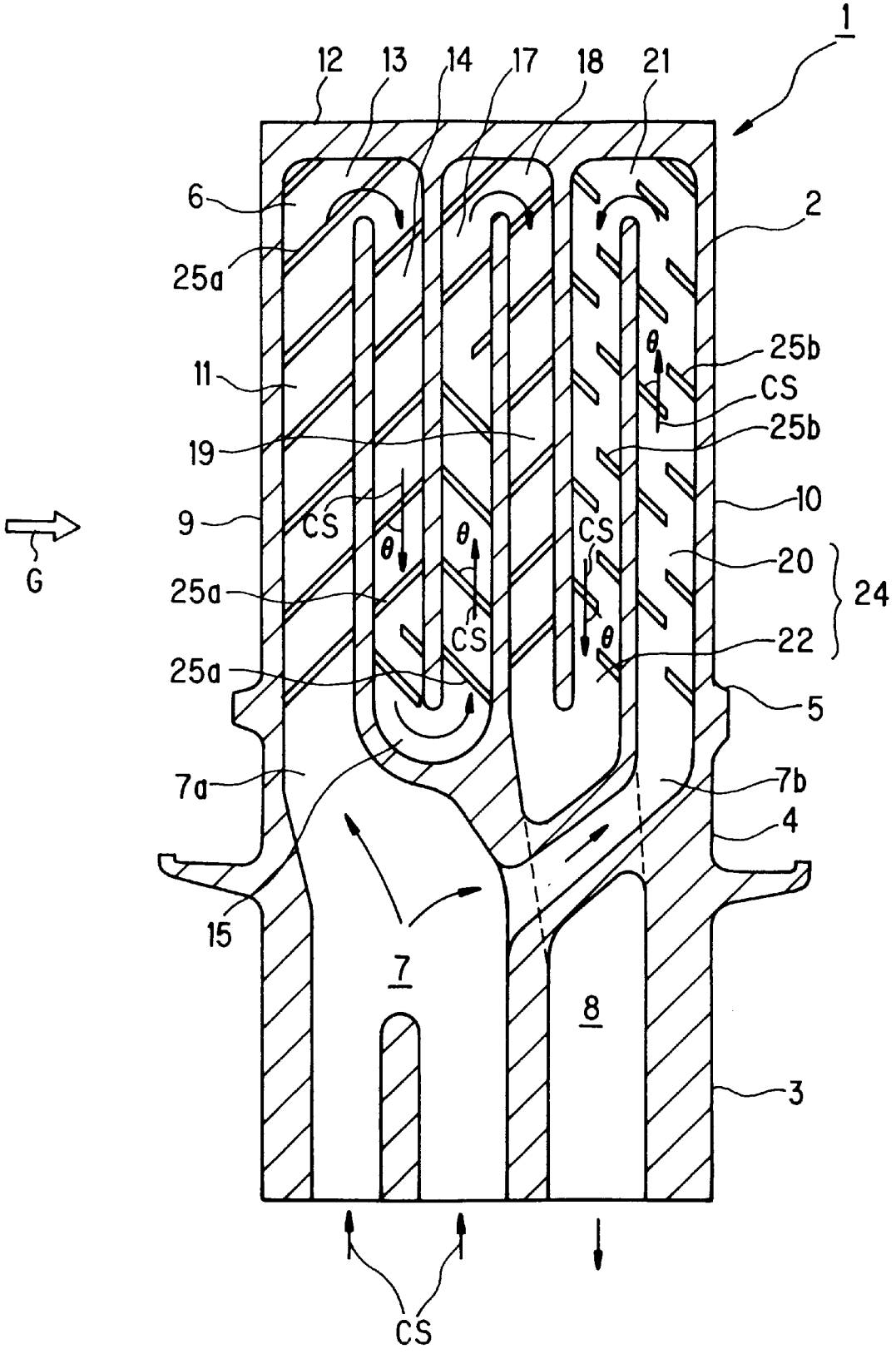
FIG. 12 is a longitudinally sectional view schematically showing a third embodiment of a gas turbine blade according to the present invention.

FIG. 12 is a longitudinally sectional view schematically showing a third embodiment of a gas turbine blade according to the present invention. Incidentally, like reference numerals are used to designate the same components as the first embodiment or parts corresponding thereto.

A gas turbine blade 1 of this third embodiment has basically the same construction as that of the first embodiment. The heat transfer accelerating element 25*a* is located from the leading edge first intermediate passage 14 to the leading edge second intermediate passage 17 through the leading edge second bent portion 15. Further, the heat transfer accelerating element 25*a* is arranged at an angle of θ inclined to the advancing flow direction of the cooling steam CS in a so-called left ascendant state in place of the right ascendant state. On the other hand, the heat transfer accelerating element 25*b* located in the trailing edge return passage 22 is arranged in two lines of stages and located at an angle of θ inclined to the advancing flow direction of the cooling steam CS in a so-called left ascendant state.

As described above, in this embodiment, when the cooling steam CS is turned by 180° at the leading edge second bent portion 15, the circulating swirl direction based on the secondary flows $SF_1$ and $SF_2$ of the leading edge first intermediate passage 14 and the circulating swirl direction based on the secondary flows $SF_1$ and $SF_2$ by the Coriolis force become reverse. In order to prevent the heat transfer coefficient of the cooling steam CS from being lowered, the heat transfer accelerating element 25*a* is located in a so-called left ascendant state inclined to the advancing flow direction of the cooling steam CS so that the circulating swirl direction based on the secondary flows $SF_1$ and $SF_2$ of the leading edge first intermediate passage 14, the circulating swirl direction based on the secondary flows $SF_1$ and $SF_2$ of the cooling steam CS which flows through the leading edge second intermediate passage 17 via the leading edge second bent portion 15, and the circulating swirl direction based on the secondary flows $SF_1$ and $SF_2$ by the Coriolis force, coincide with each other. Therefore, it is possible to keep the cooling steam CS at a high heat transfer coefficient.

Further, in this third embodiment, the heat transfer accelerating element 25*b* located in the trailing edge return passage 22 is arranged in two lines of stages, so that a heat transfer of the cooling steam can be further improved.

Figure 13:
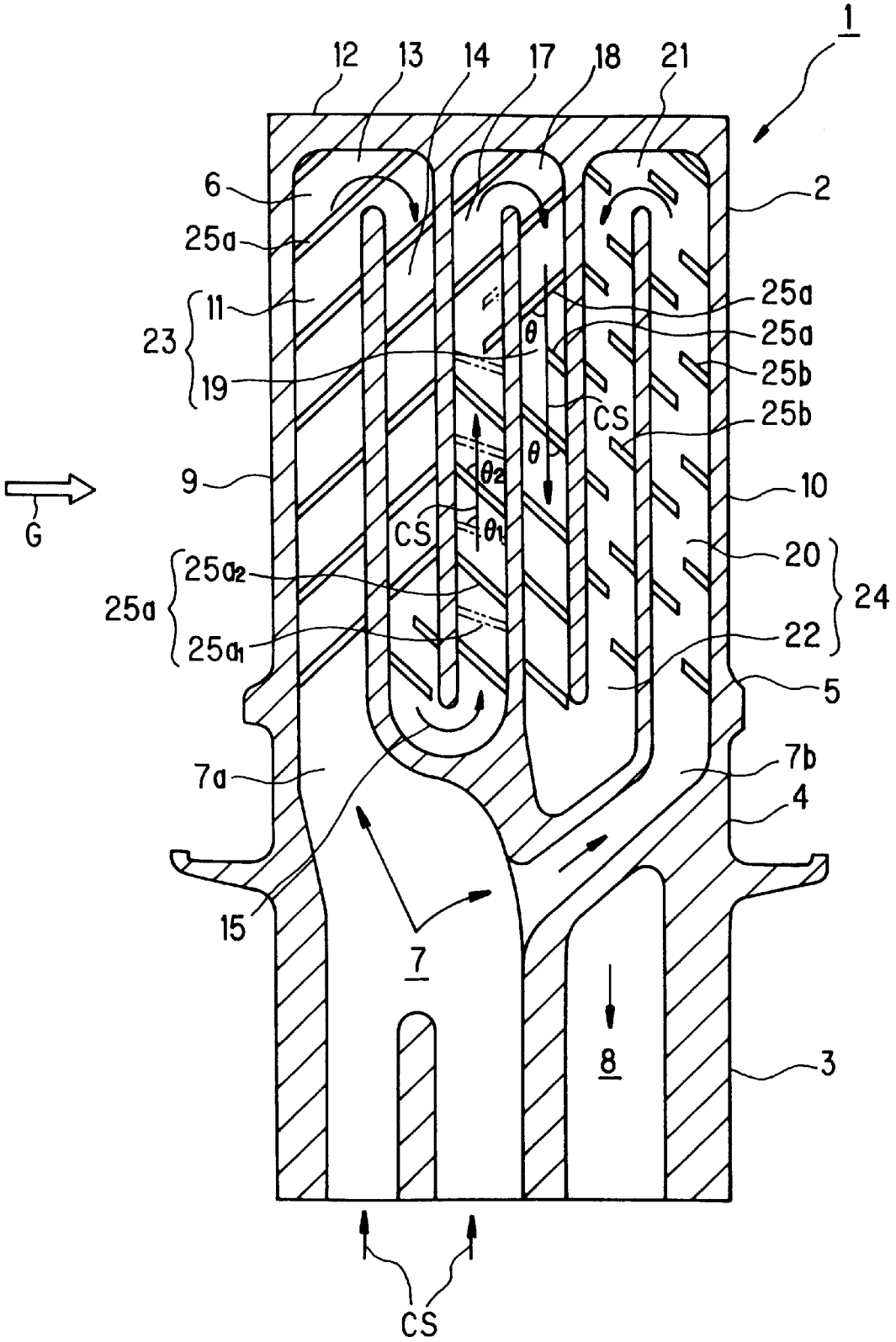
FIG. 13 is a longitudinally sectional view schematically showing a fourth embodiment of a gas turbine blade according to the present invention.

FIG. 13 is a longitudinally sectional view schematically showing a fourth embodiment of a gas turbine blade according to the present invention. Incidentally, like reference numerals are used to designate the same components as the first embodiment or parts corresponding thereto.

A gas turbine blade 1 of this embodiment has basically the same construction as the third embodiment. The heat transfer accelerating element $\mathbf{25}a_1$ (shown by a chain double-dashed line) is located on a blade wall on the ventral side of the leading edge second intermediate passage 17, and on the other hand, the heat transfer accelerating element $\mathbf{25}a_2$ (shown by a solid line) is located on a blade wall on the back side thereof. Among these heat transfer accelerating elements $\mathbf{25}a_1$ and $\mathbf{25}a_2$, the heat transfer accelerating element $\mathbf{25}a_1$ located on the ventral side is arranged at an angle of θ1 which is a so-called left ascendant state inclined to the advancing flow direction of the cooling steam CS, and on the other hand, the heat transfer accelerating element $\mathbf{25}a_2$ located on the back side is arranged at an angle of θ2 which is a so-called left ascendant state inclined to the advancing flow direction of the cooling steam CS. In this case, these angles have the following relation of θ2>θ1.

In general, in the gas turbine blade 1, the back side receives a higher thermal load as compared with the ventral side when a gas turbine driving gas G passes therethrough. For this reason, it is preferable that a circulating swirl based on the secondary flow $SF_2$ by the heat transfer accelerating element $\mathbf{25}a_2$ located on the back side is made larger so as to improve a heat transfer coefficient of the cooling steam CS. However, in actual fact, the circulating swirl based on the secondary flow $SF_1$ by the Coriolis force is generated in the ventral side, and because of this reason, this circulating swirl on the ventral side is larger than that generated in the back side.

In this embodiment, considering the technical background as described above, in order to make small the circulating swirl generated in the ventral side and to relatively made large the circulating swirl generated in the back side, the inclination angle θ2 of the heat transfer accelerating element $\mathbf{25}a_2$ to the advancing flow direction of the cooling steam CS is made lager than the inclination angle θ1 of the heat transfer accelerating element $\mathbf{25}a_1$ to the advancing flow direction of the cooling steam CS.

Therefore, in this embodiment, the circulating swirl generated in the back side is made relatively larger than the circulating swirl generated in the ventral side so as to make a balance of the heat transfer coefficient of the cooling steam CS, so that the back side and the ventral side can be uniformly cooled.

Moreover, in this embodiment, the heat transfer accelerating element 25*a* is located from the leading edge second intermediate passage 17 to the leading edge return passage 19 via the leading edge third bent portion 18. Further, the heat transfer accelerating element 25*a* is arranged at an angle of θ to the advancing flow direction of the cooling steam CS and is alternately changed from the so-called left ascendant state to the right ascendant state, and, is again changed into the left ascendant state.

Figure 14:
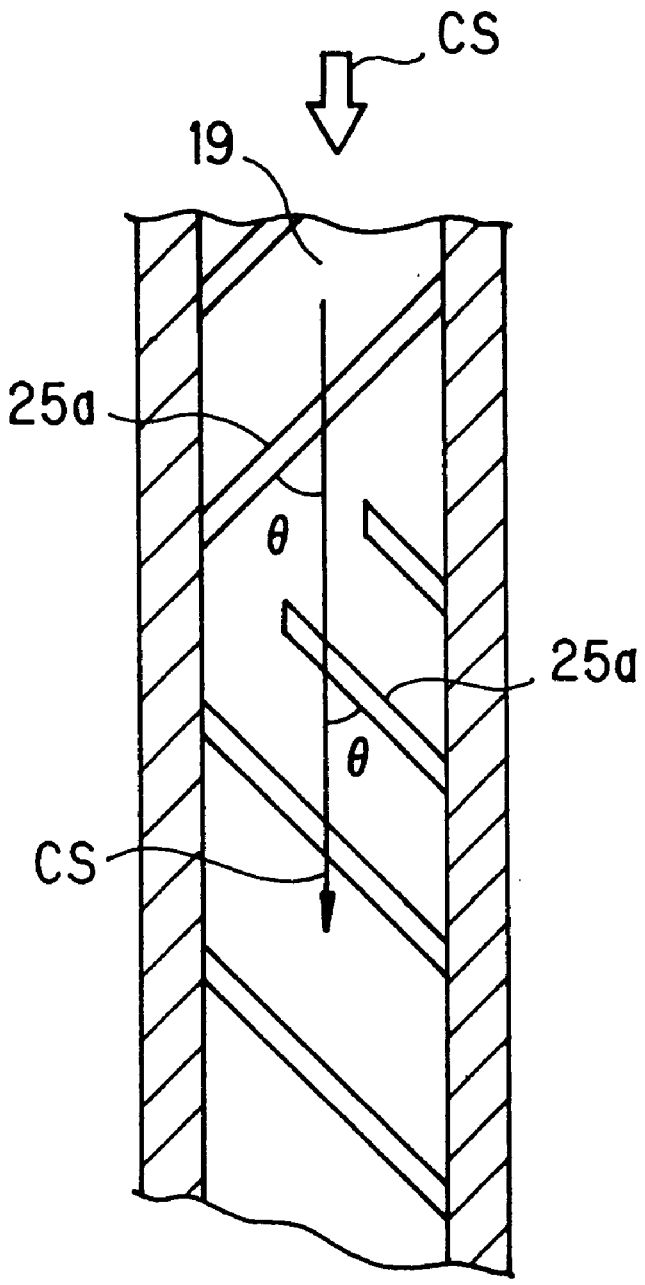
FIG. 14 is a longitudinally sectional view schematically showing a second embodiment of the heat transfer accelerating element located on an intermediate passage of the gas turbine blade shown in FIG. 13.
Figure 15:
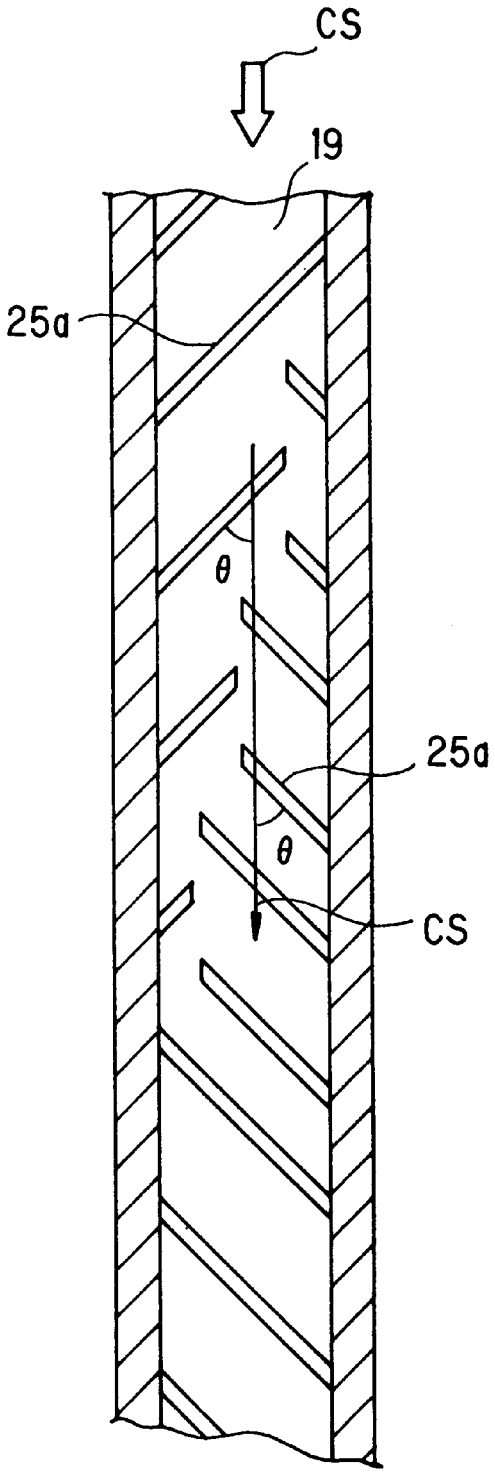
FIG. 15 is a longitudinally sectional view schematically showing a third embodiment of the heat transfer accelerating element located on the intermediate passage of the gas turbine blade shown in FIG. 13.

As described above, in this fourth embodiment, the heat transfer accelerating element 25*a* is located from the leading edge second intermediate passage 17 to the leading edge return passage 19 via the leading edge third bent portion 18. Further, the heat transfer accelerating element 25*a* is alternately changed from the so-called left ascendant state to the right ascendant state and is again changed into the left ascendant state. By doing so, the circulating swirl direction based on the secondary flows $SF_1$ and $SF_2$ by the heat transfer accelerating element 25*a* and the circulating swirl direction based on the secondary flows $SF_1$ and $SF_2$ by the Coriolis force, always coincide with each other. Therefore, it is possible to keep the cooling steam CS at a high heat transfer coefficient. The heat transfer accelerating element 25*a* has been located at an angle of θ to the advancing flow direction of the cooling steam CS and is alternately changed from the so-called left ascendant state to the right ascendant state and is again changed into the left ascendant state. As shown in FIG. 14, the heat transfer accelerating element 25*a* may be formed so as to have a length extending to a wall surface defining the leading edge return passage 19 or so as to have a relatively short length. Furthermore, as shown in FIG. 15, the heat transfer accelerating element 25*a* may be formed in the following manner. That is, the heat transfer accelerating elements 25*a* may be successively made short from the heat transfer accelerating elements 25*a* having a length extending to a wall surface defining the leading edge return passage 19 and may be successively made long so as to correspond thereto.

Figure 16:
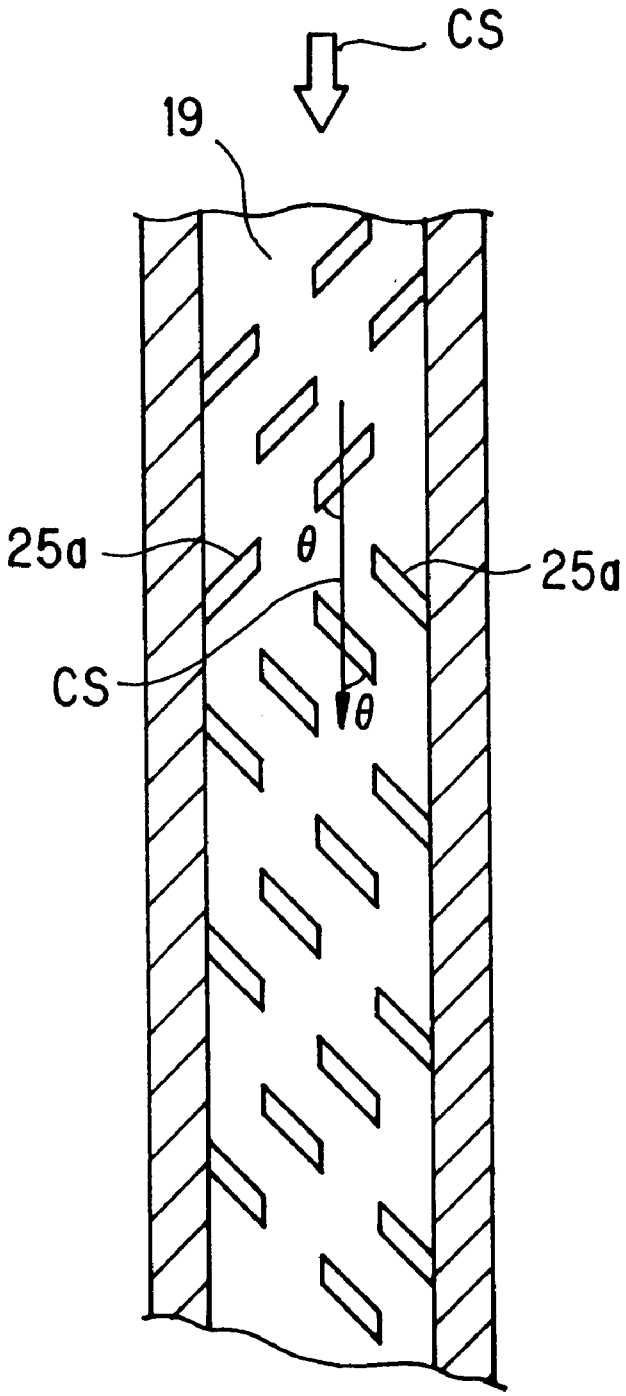
FIG. 16 is a longitudinally sectional view schematically showing a fourth embodiment of the heat transfer accelerating element located on the intermediate passage of the gas turbine blade shown in FIG. 13.
Figure 17:
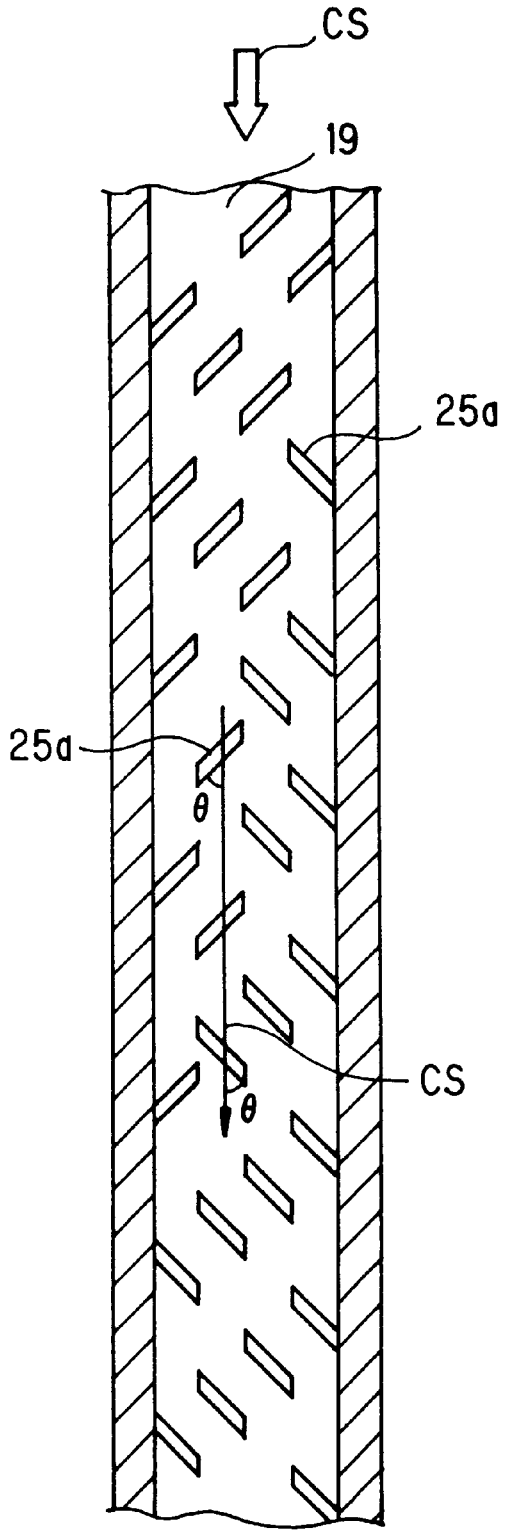
FIG. 17 is a longitudinally sectional view schematically showing a fifth embodiment of the heat transfer accelerating element located on the intermediate passage of the gas turbine blade shown in FIG. 13.

Further, in the leading edge return passage 19, the heat transfer accelerating element 25*a* is changed from the right ascendant state inclined at an angle of θ to the left ascendant state inclined at an angle of θ. As shown in FIG. 16, the heat transfer accelerating element 25*a* may be arranged in the following manner. First, the heat transfer accelerating element having a relatively short length is arranged in a right ascendant inclined state, and next, is arranged in a left ascendant inclined state in order. Further, as shown in FIG. 17, the heat transfer accelerating element having a relatively short length may be arranged with a combination of the right ascendant inclined state and the left ascendant inclined state.

In each case of FIG. 14 to FIG. 17, when the cooling steam Cs is turned by an angle of 180° at the leading edge third bent portion 18, the circulating swirl direction based on the secondary flows $SF_1$ and $SF_2$ by the heat transfer accelerating element 25*a* in the leading edge return passage 19 and the circulating swirl direction based on the secondary flows $SF_1$ and $SF_2$ by the Coriolis force, always coincide with each other. Therefore, it is possible to keep the cooling steam CS at a high heat transfer coefficient.

Figure 18:
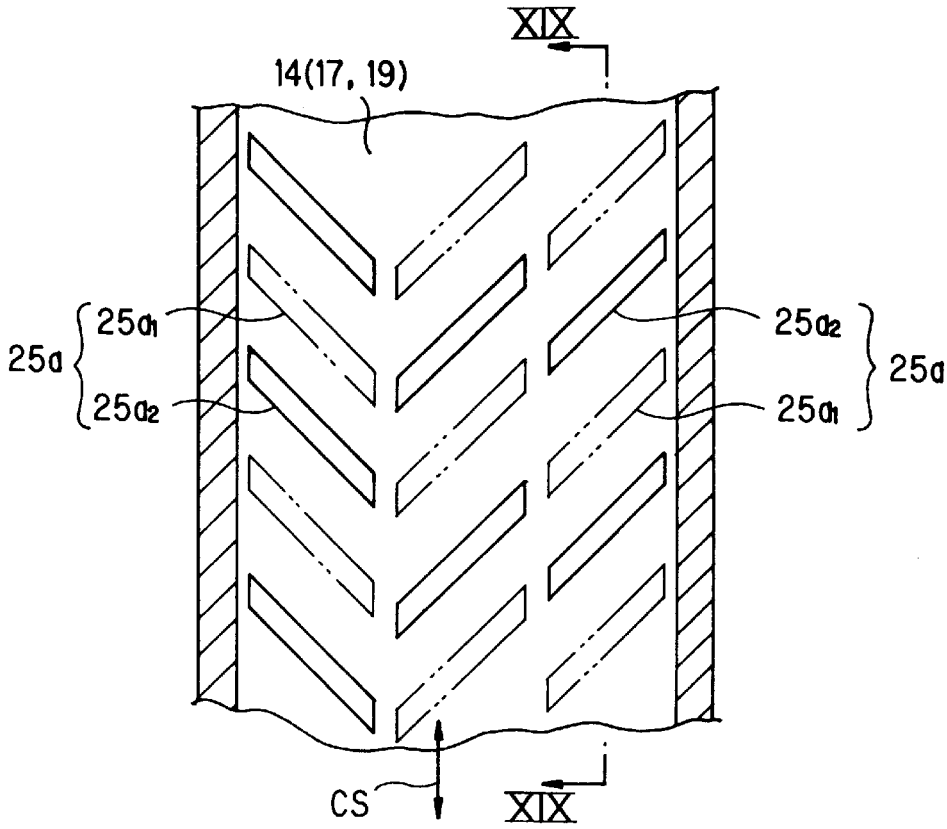
FIG. 18 is a view showing an arrangement of the heat transfer accelerating element located on the intermediate passage in a blade effective section of the gas turbine blade according to the present invention.
Figure 19:
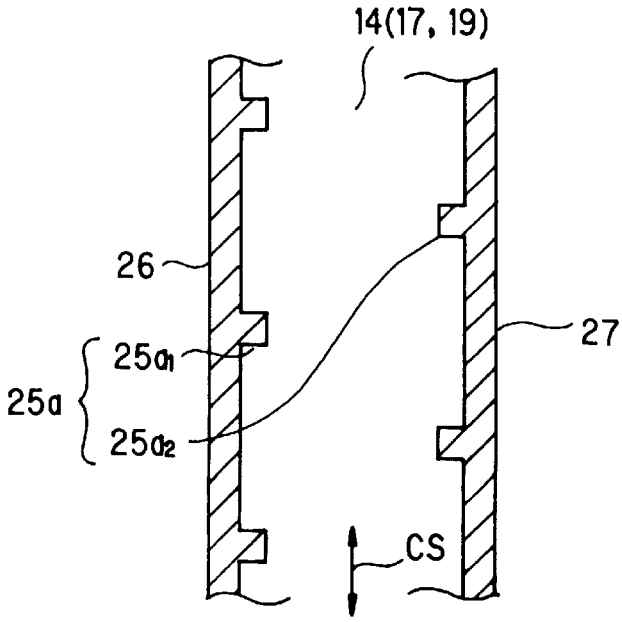
FIG. 19 is a longitudinal sectional view cut along an arrow XIX—XIX direction of FIG. 18.

Further, in this fourth embodiment, as shown in FIG. 18, a relatively short heat transfer accelerating element 25*a* is located on each middle portion of the leading edge first intermediate passage 14, the leading edge second intermediate passage 17 and the leading edge return passage 19 excluding each peripheral portion of the leading edge first bent portion 13, the leading edge second bent portion 15 and the leading edge third bent portion. The relatively short heat transfer accelerating element 25*a* is arranged successively in a left ascendant state, a right ascendant state and a right ascendant state (FIG. 18), inclined to the advancing flow direction of the cooling steam CS, that is, in at least three lines or more. The heat transfer accelerating element 25*a* arranged in at least three lines or more may be located on the ventral side (shown by a chain double-dashed line) and on the back side (shown by a solid line). In this case, as shown in FIG. 19, the heat transfer accelerating element 25*a* is arranged in a manner that a heat transfer accelerating element $25a_1$ located on the ventral side 26 and a heat transfer accelerating element $25a_2$ located on the back side 27 are alternately located with respect to the advancing flow direction of the cooling steam CS.

As described above, in this embodiment, the heat transfer accelerating element 25*a* is arranged successively in a right ascendant state and a left ascendant state, inclined to the advancing flow direction of the cooling steam CS, that is, in at least three lines of stages or more. Further, the heat transfer accelerating element $25a_1$ located on the ventral side 26 and the heat transfer accelerating element $25a_2$ located on the back side 27 are alternately located so as to further improve a heat transfer coefficient of the cooling steam CS. Therefore, it is possible to effectively make convection cooling with respect to each intermediate portion of passages 14, 17 and 19.

Figure 20:
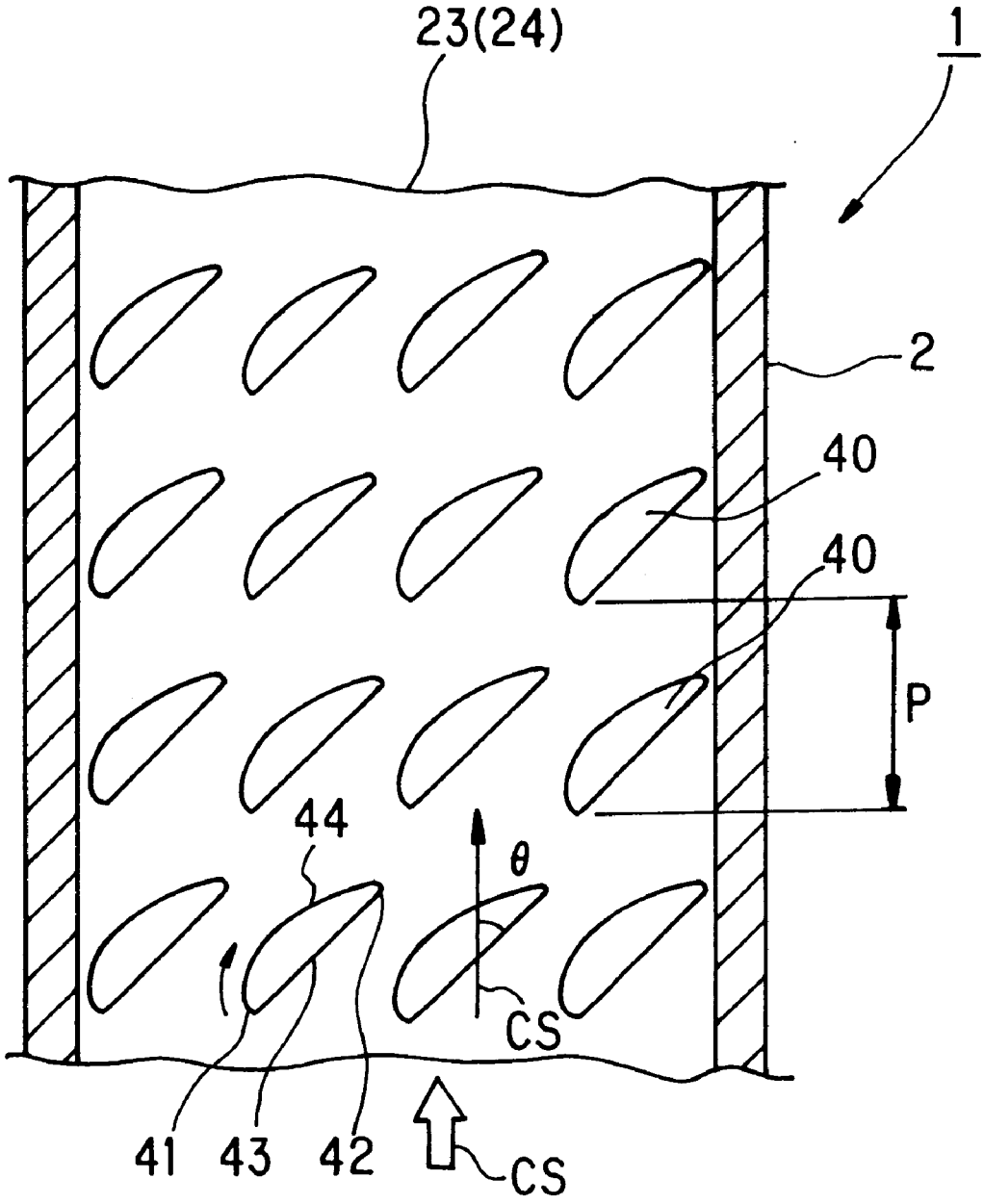
FIG. 20 is a view schematically showing another embodiment of the heat transfer accelerating element located on a cooling passage formed in a blade effective section of the gas turbine blade according to the present invention.

FIG. 20 is a view schematically showing another embodiment of the heat transfer accelerating element located on a cooling passage formed in a blade effective section of the gas turbine blade according to the present invention.

In the gas turbine blade 1 of the present invention, the blade effective section 2 is formed with the blade leading edge side cooling passage 23 and the trailing edge side cooling passage 24. These passages 23 and 24 are provided with a heat transfer accelerating element 40 according to this embodiment.

The heat transfer accelerating element 40 according to this embodiment is arranged in a plurality of lines of stages with respect to a direction crossing the advancing flow direction of the cooling steam CS which flows through the blade leading edge side cooling passage 23 and the trailing edge side cooling passage 24 formed in the blade effective section 2. Further, the heat transfer accelerating element 40 is arranged in a manner that a pitch P between an upstream side heat transfer accelerating element 40 and a downstream side heat transfer accelerating element 40 is made constant, and is located at an angle of θ in a right ascendant state inclined to the advancing flow direction of the cooling steam CS.

Figure 21:
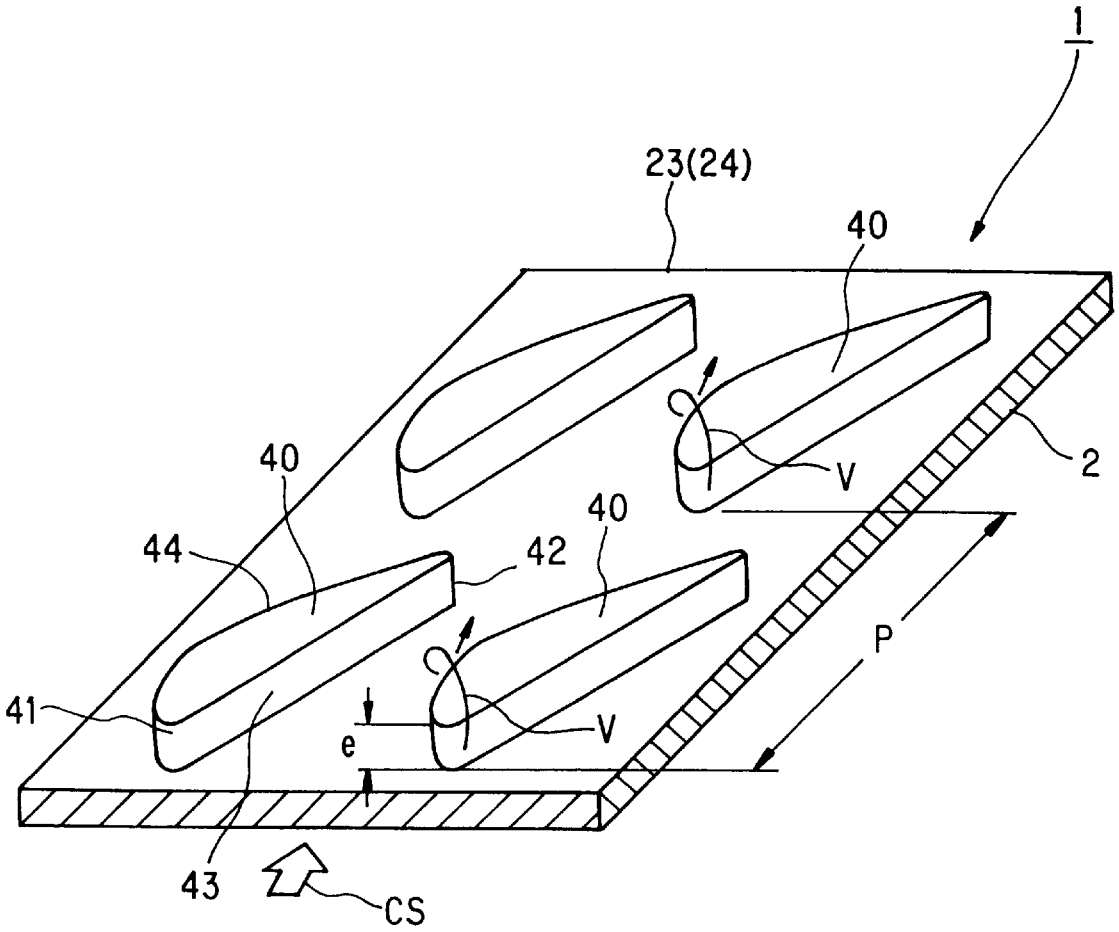
FIG. 21 is a perspective view schematically showing the heat transfer accelerating element shown in FIG. 20.

When the heat transfer accelerating element 40 has a heat transfer accelerating element leading edge 41 (i.e. leading end which is an upstream end of such an element) on an upstream side of the cooling steam CS and a heat transfer accelerating element trailing edge 42 on a downstream side thereof, as shown in FIG. 20 and FIG. 21, a ventral side line 43 connecting the heat transfer accelerating element leading edge 41 and the heat transfer accelerating element trailing edge 42 is formed into a straight line. On the other hand, a back side line 44 connecting the heat transfer accelerating element leading edge 41 and the heat transfer accelerating element trailing edge 42 is formed into a curved line (like a convex) which is bulged outwardly.

If the ventral side line 43 is formed into a curved line (like a convex) which is bulged outwardly, the cooling steam CS collides with the heat transfer accelerating element leading edge 41, and then, a flow of a circulating swirl based on the secondary flow induced by collision is made worse and is stagnant. Moreover, if the ventral side line 43 is formed into a curved line (like a concave) which is bulged inwardly, the circulating swirl based on the aforesaid secondary flow is made stagnant due to the heat transfer accelerating element trailing edge 42. Therefore, it is the most proper way to form the ventral side line 43 into a straight line.

In order to preferably guide the circulating swirl based on the secondary flow induced when the cooling steam CS collides with the heat transfer accelerating element leading edge 41 to the heat transfer accelerating element trailing edge 42, it is the most proper way that the back side line 44 is formed into a curved line (like a convex) which is bulged outwardly.

Figure 22:
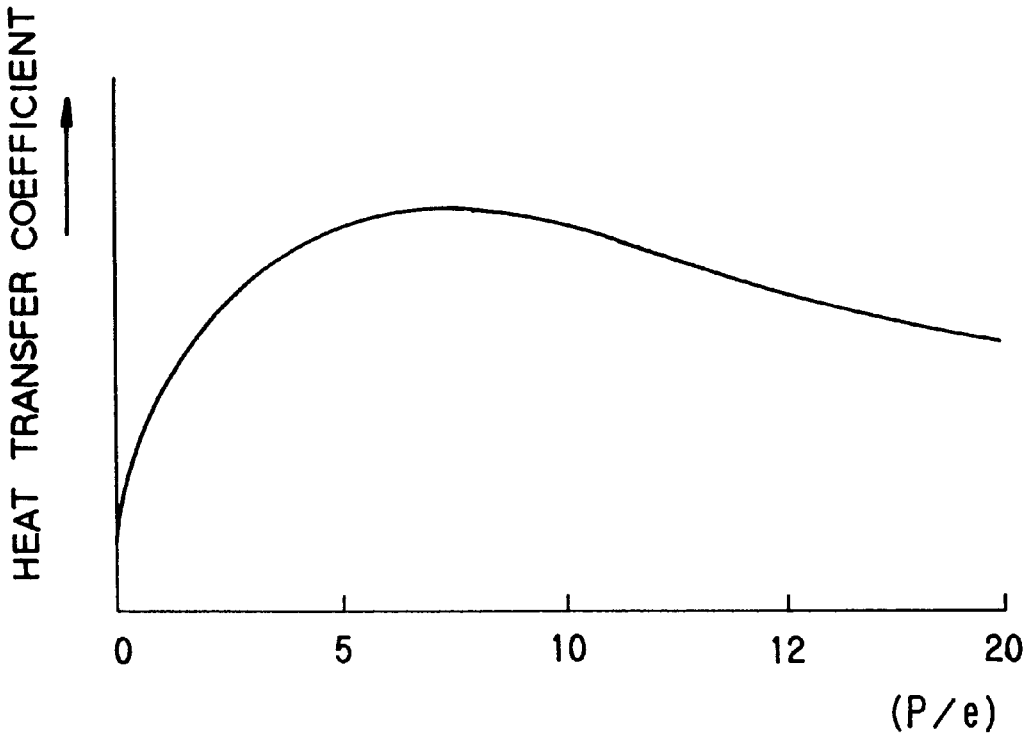
FIG. 22 is a diagram to obtain a heat transfer coefficient of a cooling medium from a height of the heat transfer accelerating element to a pitch of the heat transfer accelerating elements shown in FIG. 20, which are arranged in plural lines, that is, a pitch of the heat transfer accelerating element arranged on an upstream side in the same line and the transfer accelerating element arranged on a downstream side in the same line.

Assuming that a height of the heat transfer accelerating element 40 on the upstream and downstream sides of the cooling steam CS is set as "e", and that a pitch between the upstream side heat transfer accelerating element 40 and the downstream side heat transfer accelerating element 40 is set as "P", a ratio P/e of the pitch P to the height e is set to P/e=3 to 20 which is a proper value as shown in FIG. 22.

In general, the cooling steam CS separated from the back side line 44 of the upstream side heat transfer accelerating element 40 flows to the downstream side, and when it again adheres to the blade wall, a heat transfer coefficient becomes high. The heat transfer coefficient lowers before and after the cooling steam CS again adheres to the blade wall. This embodiment was made by taking the above matter into consideration, and a ratio of a distance where the cooling steam CS again adheres to the blade wall and the height "e"

of the heat transfer accelerating element 40 is about 2 to 3 when observed from the back side line 44. For this reason, if the pitch P between the upstream side heat transfer accelerating element 40 and the downstream side heat transfer accelerating element 40 is made small, the cooling steam CS is prevented from again adhering to the blade wall. If the pitch P is made large, a high heat transfer distribution is scattered. In each case, an average heat transfer coefficient lowers, and then, changes as shown in FIG. 22.

Therefore, in this embodiment, the ratio P/e of the pitch P of the upstream side heat transfer accelerating element 40 and the downstream side heat transfer accelerating element 40 to the height "e" of the heat transfer accelerating element 40 is set to P/e=3 to 20 which is a proper value.

As described above, in this embodiment, the heat transfer accelerating element 40 is located in the blade leading edge side cooling passage 23 and the blade trailing edge side cooling passage 24 which are formed in the blade effective section 2, and is arranged in a plurality of lines of stages at an angle of θ in a so-called right ascendant state inclined to the advancing flow direction of the cooling steam CS. Further, the ventral side line 43 connecting the heat transfer accelerating element leading edge 41 and the heat transfer accelerating element leading edge 42 of the heat transfer accelerating element 40 is formed into a straight line. On the other hand, the back side line connecting the heat transfer accelerating element leading edge 41 and the heat transfer accelerating element leading edge 42 is formed into a curved line (like a convex) which is bulged outwardly. By doing so, a vertical (longitudinal) swirl "V" based on the secondary flow, induced when the cooling steam CS collides with the heat transfer accelerating element leading edge 41, swirls up by means of the straight ventral side line 43, and then, the swirled-up vertical swirl V swirls down by means of the back side line 44 so that the vertical swirl can be effectively used, and thus, a heat transfer coefficient of the cooling steam CS can be improved. Therefore, it is possible to effectively and preferably cool the interior of the blade effective section 2 of the gas turbine blade 1.

Moreover, in this embodiment, in order that the cooling steam CS separated from the heat transfer accelerating element 40 again adheres to the blade wall, the height of the heat transfer accelerating element 40 on the upstream and downstream sides of the cooling steam CS is set as "e", and the pitch between the upstream side heat transfer accelerating element 40 and the downstream side heat transfer accelerating element 40 is set as "P", and then, a ratio P/e of the pitch "P" to the height "e" is set to P/e=3 to 20. Thus, the cooling steam CS again adheres to the blade wall, so that the heat transfer coefficient can be made high. Accordingly, it is possible to further effectively cool the interior of the blade effective section 2 of the gas turbine blade 1.

Figure 23:
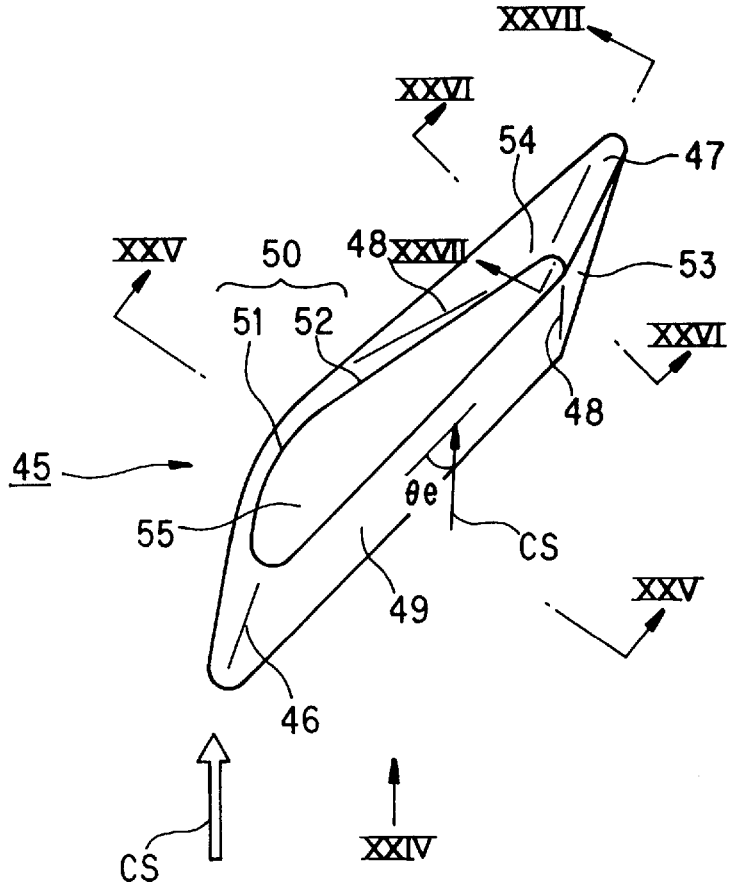
FIG. 23 is a perspective view schematically showing still another embodiment of the heat transfer accelerating element located on a cooling passage formed in a blade effective section of the gas turbine blade according to the present invention.
Figure 24:
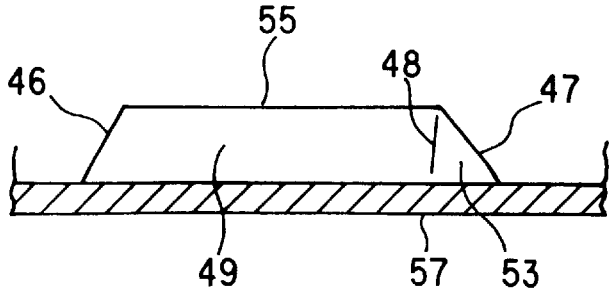
FIG. 24 is a side view showing the heat transfer accelerating element when viewing from an arrow XXIV direction of FIG. 23.

FIG. 23 is a perspective view schematically showing still another embodiment of the heat transfer accelerating element located on a cooling passage formed in a blade effective section of the gas turbine blade according to the present invention.

A heat transfer accelerating element 45 of this embodiment has a heat transfer accelerating element leading edge 46 on an upstream side of the cooling steam CS and a heat transfer accelerating element trailing edge 47 on a downstream side thereof. A turning portion 48 is formed on an intermediate portion between the heat transfer accelerating element leading edge 46 and the heat transfer accelerating element trailing edge 47. Further, a ventral side surface 49 connecting the heat transfer accelerating element leading edge 46 and the turning portion 48 is formed into a straight line, and a back side surface 50 connecting the heat transfer accelerating element leading edge 46 and the turning portion 48 is formed into a curved surface 51 which is bulged outwardly (like convex). The back side surface 50 connecting the intermediate portion and the turning portion 48 is formed into a straight surface 52. A turning ventral side surface 53 connecting the turning portion 48 and the heat transfer accelerating element trailing edge 47 is formed like a straight line, and then, is gradually bent toward the bask side surface 50. On the other hand, a turning back side surface 54 connecting the turning portion 48 and the heat transfer accelerating element trailing edge 47 is formed like a straight line.

The heat transfer accelerating element 45 of this embodiment has a top portion 55 which is formed like a flat when viewing it from an arrow G direction, a bottom portion 56 which is fixed onto the blade wall 57. Further, the heat transfer accelerating element 45 is formed so as to substantially have a parallelogram in its cross section.

Figure 25:
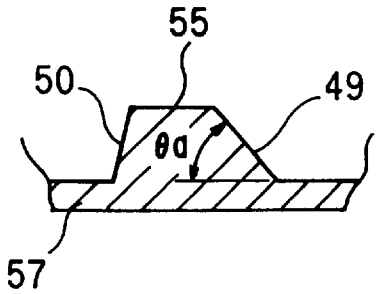
FIG. 25 is a cross sectional view cut along an arrow XXV—XXV direction of FIG. 23.

As shown in FIG. 25, in the ventral side surface 49, assuming that an inclination angle in a height direction from the blade wall 57 of the cooling passage to the top portion 55 is set as θa, the inclination angle θa is set within a range expressed by the following equation, $$30° \leqq \theta a \leqq 60°. \qquad \text{[Mathematical Equation 2]}$$

Figure 28:
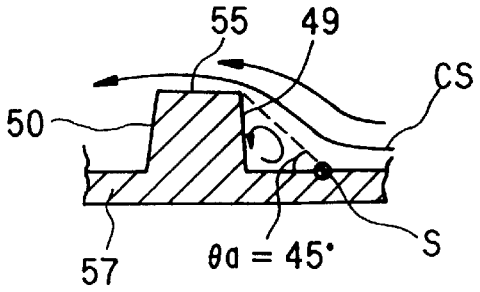
FIG. 28 is a view to explain a behavior of the cooling medium flowing through a side surface of the heat transfer accelerating element shown in FIG. 25.

The following is the reason why the inclination angle of the ventral side surface is set to the aforesaid range. As shown in FIG. 28, if the inclination angle θa exceeds an angle of 60° or more with respect to the blade wall 57, and is in a vertical state, there is a case where the cooling steam Cs jumps over the top portion 55. However, most of the cooling steam CS collides with the ventral side surface, and then, a swirl is generated. As a result, a pressure loss of the cooling steam CS increases. Conversely, if the inclination angle θa is set to 30° or less, a heat transfer coefficient of the cooling steam CS becomes low. In order to prevent the swirl from being generated, it is preferable that the inclination angle θa of the ventral side surface 49 is set to 45° in the following manner that an inclination angle shown by a broken line connecting a separation point S on the blade wall 57 of the cooling steam CS and the top portion 55.

Figure 27:
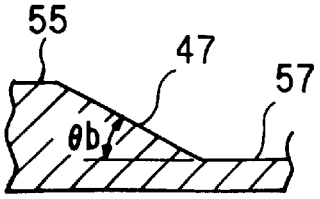
FIG. 27 is a cross sectional view cut along an arrow XXVII—XXVII direction of FIG. 23.

Moreover, in the heat transfer accelerating element trailing edge 47, as shown in FIG. 27, assuming that an inclination angle to the blade wall 57 of the cooling passage is set as θb, the inclination angle θb is set within a range expressed by the following equation, $$30° \leqq \theta b \leqq 60°. \qquad \text{[Mathematical Equation 3]}$$

Figure 29:
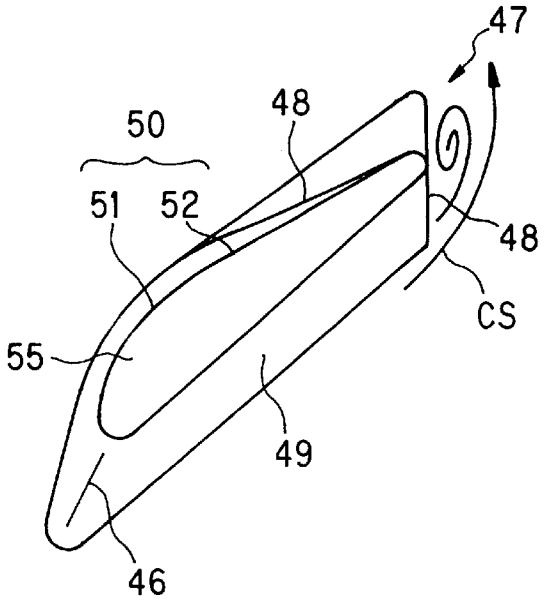
FIG. 29 is a view to explain a behavior of the cooling medium flowing through a heat transfer accelerating element trailing edge of the heat transfer accelerating element shown in FIG. 27.

If the heat transfer accelerating element trailing edge 47 has an inclination angle θb exceeding an angle of 60° to the blade wall 57, the ventral side surface 49 and the turning ventral side surface 53 of the turning portion 48 cross each other at an acute angle. As shown in FIG. 29, the secondary flow of the cooling steam CS is separated at the turning portion 48, and for this reason, a pressure loss is increased. On the contrary, if the inclination angle θb is smaller than an angle of 30°, the heat transfer accelerating element trailing edge 47 extends to the downstream side heat transfer accelerating element leading edge of the adjacent the heat transfer accelerating element arranged in a plurality of lines of stages. Accordingly, it is possible to prevent a flow of the cooling steam flowing through the adjacent downstream side heat transfer accelerating element.

Figure 26:
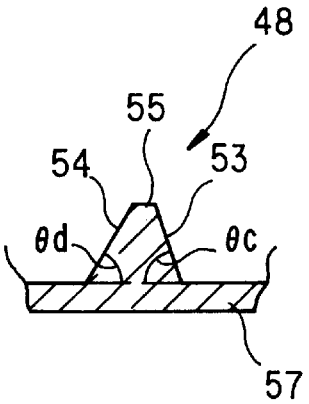
FIG. 26 is a cross sectional view cut along an arrow XXVI—XXVI direction of FIG. 23.

As shown in FIG. 26, in the turning portion 48, assuming that inclination angles of the turning ventral side surface 53 and the turning back side surface 54 are respectively set as θc, θd to the blade wall 57 of the cooling passage, the inclination angles θc and θd are set within a range expressed by the following equation, $$30° \leqq \theta c,\ \theta d \leqq 60°. \qquad \text{[Mathematical Equation 4]}$$

In general, the secondary flow of the cooling steam CS flowing along the back side surface 50 of the heat transfer accelerating element 45 becomes the maximum velocity of flow at a portion where a curvature of the heat transfer accelerating element leading edge 46 is large, and thereafter, flows inertially. However, the secondary flow is gradually decelerated while flowing to the heat transfer accelerating element trailing edge 47, and for this reason, separation is easy to be generated. In this case, when deceleration and separation are remarkably observed, there is generated a reverse flow from the heat transfer accelerating element trailing edge 47 to the heat transfer accelerating element leading edge 46. Therefore, a pressure loss becomes large. Considering the problem mentioned above into consideration, in this embodiment, the turning ventral side surface 53 and the turning back side surface 54 are formed like a straight line from the turning portion 48 to the heat transfer accelerating element trailing edge 47 in a manner that the back side surface 50 is formed by a combination of the curved surface 51 extending outwardly and the straight surface 52 so as to connect the turning portion 48.

Figure 30:
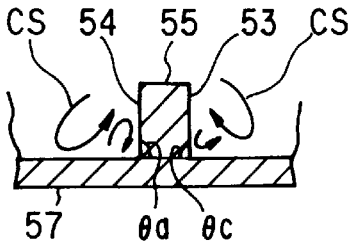
FIG. 30 is a view to explain a behavior of the cooling medium flowing through a side surface and a trailing side surface of the heat transfer accelerating element shown in FIG. 26.

If the turning ventral side surface 53 and the turning back side surface 54 respectively have the inclination angles θc and θd exceeding an angle of 60° to the blade wall 57, as shown in FIG. 30, a counter vortex (swirl generated with the secondary flow) of the cooling steam CS is generated; for this reason, a pressure loss becomes large. If the inclination angles θc and θd are smaller than an angle of 30°, it is impossible to improve a heat transfer coefficient of the cooling steam CS.

Therefore, in this embodiment, taking the aforesaid behavior of cooling steam CS into consideration, the inclination angles θc and θd of turning ventral side surface 53 and the turning back side surface 54 to the blade wall 57 are set to a range from 30° to 60°. Further, in order to reduce a pressure loss of the cooling steam CS and improve a heat transfer coefficient, it is preferable that these inclination angles θc and θd are set to an angle of 45°.

The inclination angle θa in a height direction from the blade wall 57 of the cooling passage to the top portion 55 is set to a range from 30° to 60°, and the ventral side surface 49 from the heat transfer accelerating element leading edge 45 to the turning portion 48 is formed into a straight line. In the straight line, as shown in FIG. 23, assuming that an angle intersecting the advancing flow direction of the cooling steam CS to the blade wall of the cooling passage is set as θe, this inclination angle θe is set within a range expressed by the following equation, $$30° \leqq \theta e \leqq 60°. \qquad \text{[Mathematical Equation 5]}$$

The following is the reason why the intersection angle θe of the straight line of ventral side surface 49 and the advancing flow direction of the cooling steam CS is set to the aforesaid range. If the intersection angle θe exceeds an angle of 60°, the secondary flow of the cooling steam CS is restricted. Moreover, if the intersection angle θe is smaller than an angle of 30°, the vertical swirl V shown in FIG. 21 is not effectively used; as a result, it is impossible to improve a heat transfer coefficient of the cooling steam CS. The intersection angle θ of the straight line of the ventral side line 43 shown in FIG. 20 and FIG. 21 and the advancing flow direction of the cooling steam CS is set to that range from 30° to 60°, like the above description.

Figure 31:
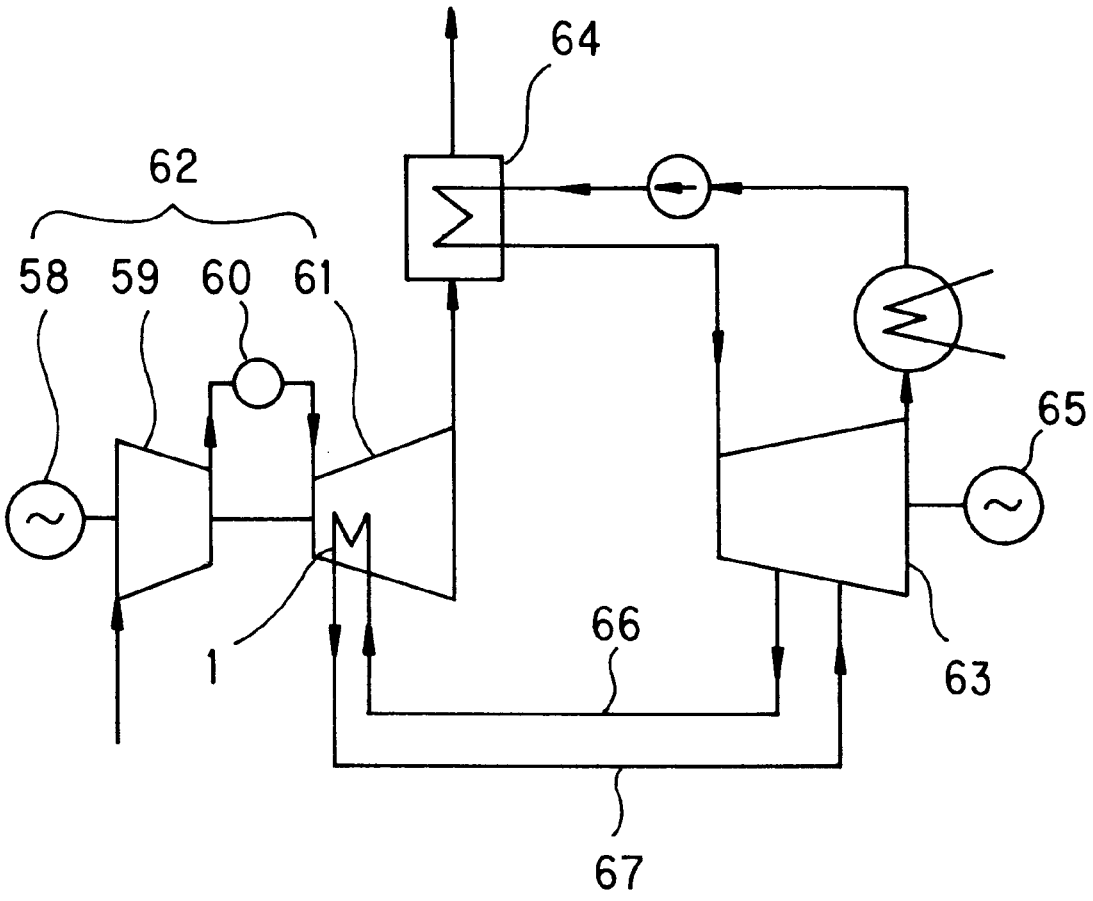
FIG. 31 is a system diagram schematically showing a steam cooling supply/recovery system when supplying and recovering a steam as a cooling medium to the heat transfer accelerating element located on a cooling passage formed in a blade effective section of the gas turbine blade according to the present invention.

FIG. 31 is a system diagram schematically showing a steam cooling supply/recovery system when supplying and recovering a steam as a cooling medium to the heat transfer accelerating element located on a cooling passage formed in a blade effective section of the gas turbine blade according to the present invention.

A recent thermal power generation plant is mainly transferring to a combined cycle power generation plant which is constructed in a manner of combining a gas turbine plant 62 comprising a generator 58, an air compressor 59, a gas turbine combustor 60 and a gas turbine 61 with a steam turbine plant 63 and an exhaust heat recovery boiler 64.

In this combined cycle power generation plant, an exhaust heat gas G, which finishes a work of expansion in the gas turbine 61, is used as a heat source, and then, a steam is generated in the exhaust heat recovery boiler 64. The steam thus generated is guided to the steam turbine 63 and performs a work of expansion so as to drive the generator 65. In this case, the gas turbine blade 1 as shown in FIG. 1, FIG. 11, FIG. 12 and FIG. 13 is incorporated into the gas turbine 61. Further, the gas turbine blade 1 is provided with a cooling steam supply system 66 for guiding a turbine extraction from the steam turbine 63 and a steam recovery system 67 for recovering the steam to the steam turbine 63 after cooled the gas turbine blade 1.

As described above, in the present embodiment, the turbine extraction from the steam supply system 66 of the steam turbine 63 is supplied as a cooling medium to the heat transfer accelerating element located in the gas turbine blade 1 and the steam cools the gas turbine blade 1, and thereafter, is recovered to the steam turbine 63 via the steam recovery system 67. Therefore, even if the gas turbine driving gas is made high temperature, it is possible to keep a high strength of the gas turbine blade 1, and improve a plant heat efficiency.

It is to be noted that the present invention is not limited to the described embodiments and many other changes and modifications may be made without departing from the scopes of the appended claims.

What is claimed is:

1. A gas turbine blade provided with a hollow blade effective section and a blade implanted section operatively connected to the blade effective section, said gas turbine blade including:

a leading edge passage for guiding a cooling medium from a supply passage of the blade implanted section on a blade leading edge side of the hollow blade effective section;

leading edge intermediate passages following the leading edge passage; and a trailing edge passage for guiding the cooling medium from the supply passage of a blade implanted section on a blade trailing edge side of the hollow blade effective section, said leading edge passage being provided with a heat transfer accelerating element which is arranged in a right ascendant state inclined to an advancing flow direction of the cooling medium when supplying the cooling medium from the blade implanted section to a blade tip section side, said trailing edge passage being provided with a heat transfer accelerating element which is arranged in a left (trailing edge counter side) ascendant state inclined to the advancing flow direction of the cooling medium when supplying the cooling medium from the blade implanted section to a blade tip section side.

2. A gas turbine blade according to claim 1, wherein said heat transfer accelerating element located on the leading edge passage and on the trailing edge passage is alternately arranged with respect to a blade wall on a ventral side and a back side.

3. A gas turbine blade according to claim 1, wherein said heat transfer accelerating element is located on one of the leading edge passage and the trailing edge passage and is arranged in plural lines of stages.

4. A gas turbine blade according to claim 3, wherein said heat transfer accelerating element located on one of the leading edge passage and the trailing edge passage and is arranged in plural lines of stages, and wherein the heat transfer accelerating element located on one line is alternately arranged with respect to a heat transfer accelerating element located on an adjacent line.

5. A gas turbine blade according to claim 1, wherein said heat transfer accelerating element located on the trailing edge passage is arranged on only blade wall on the ventral side.

6. A gas turbine according to claim 1, wherein said heat transfer accelerating element is composed of either one of a rod-like rib having a square shape in a cross section thereof or a rod-like rib having a round shape in a cross section thereof.

7. A gas turbine blade according to claim 1, wherein either air or steam is selected as the cooling medium.

8. A gas turbine blade according to claim 7, wherein a turbine extraction of a steam turbine is selected as a steam used for the cooling medium.

9. A gas turbine blade provided with a hollow blade effective section and a blade implanted section operatively connected to the blade effective section, said gas turbine blade including:

a leading edge passage for guiding a cooling medium from a supply passage of the blade implanted section on a blade leading edge side of the hollow blade effective section;

a leading edge intermediate passage for supplying a cooling medium flow between a leading edge bent portion formed on a blade tip section side and on a blade implanted section side;

a leading edge return passage for recovering the cooling medium from the leading edge intermediate passage to a recovery passage of the blade implanted section by turns;

a trailing edge passage for guiding the cooling medium from a supply passage of the blade implanted section on a blade trailing edge side of the hollow blade effective section; and a trailing edge return passage for recovering the cooling medium to the recovery passage of the blade implanted section via a trailing edge bent portion formed on the blade tip section side, said leading edge passage, said leading edge intermediate passage and said leading edge return passage being provided with a heat transfer accelerating element which is arranged in a right ascendant state inclined to an advancing flow direction of the cooling medium, and said trailing edge passage and said trailing edge return passage being provided with a heat transfer accelerating element which is arranged in a left ascendant state inclined to the advancing flow direction of the cooling medium.

10. A gas turbine blade according to claim 9, wherein said leading edge bent portion on the blade implanted section side of the leading edge intermediate passage is provided with a guide plate.

11. A gas turbine blade provided with a hollow blade effective section and a blade implanted section operatively connected to the blade effective section, said gas turbine blade including:

a trailing edge passage for guiding a cooling medium from a blade trailing edge outer side supply passage blade implanted section on a blade trailing edge side of the hollow blade effective section;

a leading edge passage for recovering the cooling medium from the trailing edge passage to a blade leading edge outer side recovery passage of the blade implanted section via a blade tip section passage formed on a blade tip section side;

a blade trailing edge inner side passage which is formed on an inner side of the trailing edge passage, the blade tip section passage and the leading edge passage, and guides the cooling medium from a blade trailing edge inner side supply passage independent from the blade trailing edge outer side supply passage;

an inner side intermediate passage for guiding the cooling medium flow between a bent portion formed on the blade tip section passage side and on the blade platform side; and a leading edge inner side passage for recovering the cooling medium from the inner side intermediate passage to a blade leading edge inner side recovery passage independent from the blade leading edge outer side recovery passage, said trailing edge passage, said blade tip section passage, said leading edge passage, said blade trailing edge inner side passage, said inner side intermediate passage and said leading edge inner side passage being provided with heat transfer accelerating elements which are arranged in a left ascendant state inclined to the advancing flow direction of the cooling medium.

12. A gas turbine blade according to claim 11, wherein a guide plate is provided at a bent portion on the blade platform side of the inner side intermediate passage.

13. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium flow between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from the supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage on an upstream side of the cooling medium of the leading edge intermediate passages being provided with a heat transfer accelerating element which is arranged in a right ascendant state inclined to the advancing flow direction of the cooling medium, said adjacent leading edge intermediate passage on a downstream side of the cooling medium being provided with a heat transfer accelerating element which is arranged in a left ascendant state inclined to the advancing flow direction of the cooling medium, said leading edge return passage being provided with a heat transfer accelerating element which is arranged in a right ascendant state inclined to the advancing flow direction of the cooling medium, and said trailing edge passage and said trailing edge return passage being provided with a heat transfer accelerating element which is arranged in a left ascendant state inclined to the advancing flow direction of the cooling medium.

14. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium flow between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from the supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage being provided with heat transfer accelerating elements which are arranged in a left ascendant state inclined to the advancing flow direction of the cooling medium from the leading edge bent portion of the blade implanted section of the leading edge intermediate passage to the adjacent leading edge intermediate passage on a downstream side of the cooling medium, and which are located on a ventral side and a back side, said leading edge intermediate passage on an upstream side of the cooling medium of the leading edge intermediate passages being provided with a heat transfer accelerating element which is arranged in a left ascendant state inclined to the advancing flow direction of the cooling medium, said adjacent leading edge intermediate passage on a downstream side of the cooling medium being provided with a heat transfer accelerating element which is arranged in a left ascendant state inclined to the advancing flow direction of the cooling medium, and said trailing edge passage and said trailing edge return passage being provided with with a heat transfer accelerating element which is arranged in a left ascendant state inclined to the advancing flow direction of the cooling medium.

15. A gas turbine blade according to claim 14, wherein said heat transfer accelerating elements located on the ventral side and the back side is alternately arranged.

16. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from the supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage being provided with heat transfer accelerating elements which are arranged in a left ascendant state inclined to the advancing flow direction of the cooling medium from the leading edge bent portion of the blade implanted section of the leading edge intermediate passage to the adjacent leading edge intermediate passage on a downstream side of the cooling medium, and which are located on a ventral side and a back side, said leading edge intermediate passage on an upstream side of the cooling medium of the leading edge intermediate passages being provided with a heat transfer accelerating element which is arranged in a left ascendant state inclined to the advancing flow direction of the cooling medium, said adjacent leading edge intermediate passage on a downstream side of the cooling medium being provided with a heat transfer accelerating element which is arranged in a left ascendant state inclined to the advancing flow direction of the cooling medium, and said trailing edge passage and said trailing edge return passage being provided with a heat transfer accelerating element which is arranged in a left ascendant state inclined to the advancing flow direction of the cooling medium; and wherein said heat transfer accelerating element located on the back side has an intersecting angle to the advancing flow direction of the cooling medium relatively larger than an intersecting angle to the advancing flow direction of the cooling medium of the heat transfer accelerating element located on the ventral side.

17. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from the supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage being provided with heat transfer accelerating elements which are arranged in a left ascendant state inclined to the advancing flow direction of the cooling medium from the leading edge bent portion of the blade implanted section of the leading edge intermediate passage to the adjacent leading edge intermediate passage on a downstream side of the cooling medium, and which are located on a ventral side and a back side, said leading edge intermediate passage on an upstream side of the cooling medium of the leading edge intermediate passages being provided with a heat transfer accelerating element which is arranged in a left ascendant state inclined to the advancing flow direction of the cooling medium, said adjacent leading edge intermediate passage on a downstream side of the cooling medium being provided with a heat transfer accelerating element which is arranged in a left ascendant state inclined to the advancing flow direction of the cooling medium, and said trailing edge passage and said trailing edge return passage being provided with a heat transfer accelerating element which is arranged in a left ascendant state inclined to the advancing flow direction of the cooling medium; and wherein said heat transfer accelerating elements are changed from the right ascendant inclined state to the left ascendant inclined state with respect to the advancing flow direction of the cooling medium from the leading edge bent portion on the blade tip section side of the leading edge intermediate passage in a manner of forming the heat transfer accelerating element so as to be changed from one having a relatively long length to one having a relatively short length.

18. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from the supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage being provided with heat transfer accelerating elements which are arranged in a left ascendant state inclined to the advancing flow direction of the cooling medium from the leading edge bent portion of the blade implanted section of the leading edge intermediate passage to the adjacent leading edge intermediate passage on a downstream side of the cooling medium, and which are located on a ventral side and a back side, said leading edge intermediate passage on an upstream side of the cooling medium of the leading edge intermediate passages being provided with a heat transfer accelerating element which is arranged in a left ascendant state inclined to the advancing flow direction of the cooling medium, said adjacent leading edge intermediate passage on a downstream side of the cooling medium being provided with a heat transfer accelerating element which is arranged in a left ascendant state inclined to the advancing flow direction of the cooling medium, and said trailing edge passage and said trailing edge return passage being provided with a heat transfer accelerating element which is arranged in a left ascendant state inclined to the advancing flow direction of the cooling medium; and wherein the heat transfer accelerating elements located in the leading edge intermediate passage, each include a relatively short heat transfer accelerating element which is arranged in a right ascendant state inclined to the advancing flow direction of the cooling medium, and a relatively short heat transfer accelerating element which is arranged in a left ascendant state inclined to the advancing flow direction of the cooling medium.

19. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium flow between a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage and the leading edge return passage being provided with a heat transfer accelerating element which is alternately arranged in a left ascendant state and a right ascendant state inclined to the advancing flow direction of the cooling medium and is located in at least two lines or more of stages, and said trailing edge passage and the trailing edge return passage being provided with a heat transfer accelerating element which is arranged in a left ascendant state inclined to the advancing flow direction of the cooling medium.

20. A gas turbine blade provided with a hollow blade effective section and a blade implanted section operatively connected to the blade effective section, said gas turbine blade including:

a leading edge passage for guiding a cooling medium from a supply passage of a blade implanted section on a blade leading edge side of a hollow blade effective section;

a leading edge intermediate passage for supplying a cooling medium via a leading edge bent portion formed on a blade tip section side and on a blade implanted section side;

a leading edge return passage for recovering the cooling medium from the leading edge intermediate passage to a recovery passage of the blade implanted section;

a trailing edge passage for guiding the cooling medium from a supply passage of the blade implanted section on a blade trailing edge side of the hollow blade effective section; and a trailing edge return passage for recovering the cooling medium to a recovery passage of the blade implanted section via a trailing edge bent portion formed on the blade tip section side, said leading edge passage being provided with a heat transfer accelerating element which is arranged in a right ascendant state inclined to an advancing flow direction of the cooling medium, said leading edge intermediate passage and the leading edge return passage being provided with a heat transfer accelerating element which is alternately arranged in a left ascendant state and a right ascendant state inclined to the advancing flow direction of the cooling medium and is located in at least two lines or more of stages, and said trailing edge passage and the trailing edge return passage being provided with a heat transfer accelerating element which is arranged in a left ascendant state inclined to the advancing flow direction of the cooling medium; and wherein said leading edge intermediate passage and the leading edge return passage are provided with a heat transfer accelerating element which is alternately arranged in a left ascendant state and a right ascendant state inclined to the advancing flow direction of the cooling medium, and is located in at least two lines or more, and the heat transfer accelerating element is alternately arranged with respect to the blade wall on the ventral side and on the back side.

21. A gas turbine blade, wherein a heat transfer accelerating element is constructed in a manner that an upstream side of the advancing flow direction of a cooling medium is formed as a heat transfer accelerating element leading edge, a downstream side thereof is formed as a heat transfer accelerating element trailing edge, a ventral side line connecting the heat transfer accelerating element leading edge and the heat transfer accelerating element trailing edge is formed into a straight line, and a back side line connecting the heat transfer accelerating element leading edge and the heat transfer accelerating element trailing edge is formed into a curved line which is bulged outwardly, and that the heat transfer accelerating element thus formed is located in plural lines in a cooling passage of a hollow blade effective section.

22. A gas turbine blade according to claim 21, wherein in said the heat transfer accelerating elements located in plural lines of stages, assuming that a pitch of the heat transfer accelerating element on the upstream side on the same line and the heat transfer accelerating element on the downstream side on the same line is set as P, and a height of the heat transfer accelerating element is set as e, a ratio of the pitch P to the height e is set within a range expressed by the following equation, $$P/e=3 \text{ to } 20. \qquad \text{[Mathematical Equation 1]}$$

23. A gas turbine blade, wherein a heat transfer accelerating element is constructed in a manner that an upstream side of the advancing flow direction of a cooling medium is formed as a heat transfer accelerating element leading edge, a downstream side thereof is formed as a heat transfer accelerating element trailing edge, a turning portion is formed at an intermediate portion of the heat transfer accelerating element leading edge and the heat transfer accelerating element trailing edge, a ventral side surface connecting the heat transfer accelerating element leading edge and the turning portion is formed into a straight line, a back side surface connecting the heat transfer accelerating element leading edge and the turning portion is formed into a curved line which is bulged outwardly, the back side surface connecting the intermediate portion and the turning portion is formed into a linear surface, a turning ventral side surface connecting the turning portion and the heat transfer accelerating element leading edge is formed into a straight line and is bent toward the back side surface, and that a turning back side surface connecting the turning portion and the heat transfer accelerating element trailing edge is formed into a straight line, and the heat transfer accelerating element thus formed is located in plural lines of stages in a cooling passage of a hollow blade effective section.

24. A gas turbine blade according to claim 23, wherein assuming that an inclination angle in a height direction from the blade wall of the cooling passage to the top portion is set as θa, the inclination angle θa of the ventral side surface is set within a range expressed by the following equation, $$30° \leqq \theta a \leqq 60°. \quad \text{[Mathematical Equation 2]}$$

25. A gas turbine blade according to claim 23, wherein assuming that an inclination angle to the blade wall of the cooling passage is set as θb, the inclination angle θb of the heat transfer accelerating element trailing edge is set within a range expressed by the following equation, $$30° \leqq \theta b \leqq 60°. \quad \text{[Mathematical Equation 3]}$$

26. A gas turbine blade according to claim 23, wherein assuming that inclination angles of the turning ventral side surface and the turning back side surface of the turning portion are respectively set as θc, θd to the blade wall of the cooling passage, the inclination angles θc and θd are set within a range expressed by the following equation, $$30° \leqq \theta c,\ \theta d \leqq 60°. \quad \text{[Mathematical Equation 4]}$$

27. A gas turbine blade according to claim 23, wherein assuming that the ventral side surface is formed into a straight line so as to connecting the heat transfer accelerating element leading edge and the turning portion, and an angle intersecting the advancing flow direction of the cooling medium to the blade wall of the cooling passage is set as θe, the inclination angle θe of the ventral side surface is set within a range expressed by the following equation, $$30° \leqq \theta e \leqq 60°. \quad \text{[Mathematical Equation 5]}$$

* * * * *